US010648664B2

(12) United States Patent
Reed et al.

(10) Patent No.: US 10,648,664 B2
(45) Date of Patent: May 12, 2020

(54) HIGH EFFICIENCY MODULATING GAS FURNACE

(71) Applicant: Rheem Manufacturing Company, Atlanta, GA (US)

(72) Inventors: Shawn A Reed, Charleston, AR (US); Scott Willbanks, Fort Smith, AR (US); Robert S. Neihouse, Fort Smith, AR (US); Robert Kepesky, Greenwood, AR (US); Kevin Thompson, Avon, IN (US); Joey Huffaker, Rudy, AR (US); Daniel Schmalz, Lavaca, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 97 days.

(21) Appl. No.: 15/845,344

(22) Filed: Dec. 18, 2017

(65) Prior Publication Data

US 2019/0186737 A1 Jun. 20, 2019

(51) Int. Cl.

| | |
|---|---|
| ***F24H 9/20*** | (2006.01) |
| ***F23N 5/18*** | (2006.01) |
| ***F23N 3/08*** | (2006.01) |
| ***F24H 3/08*** | (2006.01) |

(52) U.S. Cl.

CPC ..... *F23N 5/184* (2013.01); *F23N 3/082* (2013.01); *F24H 3/087* (2013.01); *F24H 9/2085* (2013.01); *F23N 2033/10* (2013.01)

(58) Field of Classification Search

CPC ..... F23N 3/082; F23N 5/184

See application file for complete search history.

(56) References Cited

U.S. PATENT DOCUMENTS

| | | | | |
|---|---|---|---|---|
| 4,251,025 | A | 2/1981 | Bonne et al. | |
| 4,483,672 | A | 11/1984 | Wallace et al. | |
| 4,815,524 | A | 3/1989 | Dempsey et al. | |
| 5,616,995 | A | 4/1997 | Hollenbeck | |
| 5,682,826 | A | 11/1997 | Hollenbeck | |
| 5,791,332 | A | 8/1998 | Thompson et al. | |
| 6,257,870 | B1 | 7/2001 | Hugghins et al. | |
| 7,020,543 | B1 * | 3/2006 | Jaeschke | F23N 5/00 219/497 |
| 8,925,541 | B2 | 1/2015 | Thompson | |
| 9,261,277 | B2 | 2/2016 | Hugghins et al. | |
| 9,335,045 | B2 | 5/2016 | Kowald et al. | |
| 2011/0111352 | A1 * | 5/2011 | Hugghins | F23N 3/082 431/2 |
| 2013/0045451 | A1 * | 2/2013 | Shellenberger | F24H 3/065 431/12 |

* cited by examiner

*Primary Examiner* — Jason Lau
(74) *Attorney, Agent, or Firm* — Troutman Sanders LLP

(57) ABSTRACT

A high-efficiency modulating gas furnace (herein 'gas furnace') includes a furnace controller. The gas furnace further includes a gas valve and at least one pressure switch that is coupled to the furnace controller. The electrical contacts of the at least one pressure switch are removed from a series electrical circuit with the gas valve such that the gas furnace operates without de-energizing the gas valve as soon as the electrical contacts of the at least one pressure switch are opened. Further, the furnace controller operates the induced draft blower at or close to a lowest RPM at which the electrical contacts of the at least one pressure switch can be kept closed, which is between a make point RPM at which the electrical contacts of the at least one pressure switch close and a break point RPM at which the electrical contacts of the at least one pressure switch open.

17 Claims, 25 Drawing Sheets

HIGH EFFICIENCY MODULATING GAS FURNACE

TECHNICAL FIELD

The present disclosure relates generally to furnaces, and more particularly to a high efficiency modulating gas furnace.

BACKGROUND

A typical condensing gas furnace includes an induced draft blower that (a) pulls combustion air into the gas furnace, (b) pulls combustion gases (flue gases) resulting from igniting a mixture of the combustion air with gaseous fuel through a heat exchanger of the gas furnace, and (c) pushes the combustion gases out through venting ducts (vents) attached to the gas furnace. For practical reasons, the gas furnace is designed for use in different applications that may require different venting conditions, such as, but not limited to, direct venting, non-direct venting, short vents, long vents with elbows, etc. To ensure that the gas furnace functions under the different venting conditions, the induced draft blower of the gas furnace is generally operated at high RPMs. Operating the induced draft blower at high RPMs allows the combustion gases to be pushed out through the vents when the gas furnace is attached to long vents and/or vents with elbows. However, when the gas furnace is used with vents having shorter length and/or vents having minimal or no elbow, operating the induced draft blower at high RPMs reduces the efficiency of the gas furnace. The high RPM of the induced draft blower causes the combustion gases to flow through the heat exchanger of the gas furnace rapidly without having adequate time for efficient thermal transfer before being exhausted through the vents having shorter length with minimal or no elbow. That is, conventional gas furnaces are not adaptable to work under different venting conditions without compromising the efficiency of the gas furnaces.

Further, in conventional gas furnaces, to meet safety standards such as 1ANSI Z21.47, ANSI Z21.20, National Electric Code, CAN/CSA C22.2 No 199-M89, etc., electrical contacts of a pressure switch which confirms proper operation of the induced draft blower are typically connected in series with a relay controlling the gas valve. The series electrical connection between the pressure switch and the relay that controls the gas valve of the gas furnace allows the safety standard to be met by shutting off the gas valve output and ending the heating sequence in the event that the electrical contacts of the pressure switch are opened, even for a very short period of time. The electrical contacts of the pressure switch may be opened responsive to transients in pressure caused by conditions such as, but not limited to, (a) the impeller wheel of the induced draft blower passing over the pressure switch measuring port, (b) water temporarily blocking the pressure switch measuring port and (c) wind gusts blowing into the furnace exhaust vent. In conventional gas furnaces these conditions cannot be ignored due to the quick loss of flame once the electrical contacts of the pressure switch are opened and consequently the gas valve is de-energized. Every time the heating sequence of the gas furnace is ended, it takes several minutes to recover and re-start the heating sequence of the gas furnace which may be inconvenient and may negatively affect the efficiency of the gas furnace.

To prevent the shutting down and restarting of the heating sequence resulting from transients in pressure, in conventional gas furnaces, the induced draft blower is operated at a RPM considerably higher than that needed to close the electrical contacts of the pressure switch. Operating the induced draft blower at higher RPMs ensures that the heating sequence of the conventional gas furnaces does not shut off unnecessarily as a result of transients in pressure. However, as discussed above, operating the induced draft blower at higher RPMs results in reduced efficiency of the conventional gas furnaces.

In light of the above mentioned shortcomings of conventional gas furnaces, there is a need for a gas furnace with an improved control of the induced draft blower to maximize the efficiency of the gas furnace. It is noted that this background information is provided to reveal information believed by the applicant to be of possible relevance to the present disclosure. No admission is necessarily intended, nor should be construed, that any of the preceding information constitutes prior art against the present disclosure.

SUMMARY

In one aspect, the present disclosure relates to a gas furnace. The gas furnace includes a furnace controller, and an induced draft blower that is coupled to the furnace controller. The induced draft blower includes an inducer motor that is controlled by the furnace controller and an inducer fan that is coupled to the inducer motor. Further, the gas furnace includes a pressure switch assembly that is coupled to the furnace controller. The pressure switch assembly includes at least one pressure switch associated with a firing rate of the gas furnace. An input contact of the at least one pressure switch is connected to an output port of the furnace controller that supplies power to the at least one pressure switch, and an output contact of the at least one pressure switch is connected to an input port of the furnace controller. Furthermore, the gas furnace includes a gas valve that is connected to an electrical relay, and a backup electrical relay that is connected in series with the electrical relay. An input terminal of the backup electrical relay is connected to the output port of the furnace controller. Upon receiving a heat call, the furnace controller is configured to operate the induced draft blower at or close to a lowest speed that is needed to keep electrical contacts of the at least one pressure switch closed. The lowest speed that is needed to keep electrical contacts of the at least one pressure switch closed is below a make point speed of the induced draft blower at which the electrical contacts of the at least one pressure switch close at a steady-state heating condition of the gas furnace, but above a break point speed of the induced draft blower at which the electrical contacts of the at least one pressure switch open at the steady-state heating condition of the gas furnace.

In another aspect, the present disclosure relates to a system that includes a gas furnace. The gas furnace includes an induced draft blower that is coupled to a furnace controller, and a pressure switch assembly that is coupled to the furnace controller. The pressure switch assembly includes at least one pressure switch associated with a firing rate of the gas furnace. An input contact of the at least one pressure switch is connected to an output port of the furnace controller that supplies power to the at least one pressure switch, and an output contact of the at least one pressure switch is connected to an input port of the furnace controller. The furnace controller is configured to receive a first heat call. Further, the furnace controller is configured to learn and record at the furnace controller: a make point speed at which electrical contacts of the at least one pressure switch close during a combustion heat cycle when the gas furnace is operating at a steady-state heating condition, and a break point speed at which electrical contacts of the at least one pressure switch open during the combustion heat cycle when the gas furnace is operating at the steady-state heating condition. The furnace controller learns and records another make point speed at which the electrical contacts of at least one pressure switch close during the combustion heat cycle prior to an ignition sequence of a combustion heat cycle. Responsive to recording the make point speed, the break point speed, and the other make point speed, the furnace controller is configured to increase a speed of the induced draft blower to a make point speed to close the electrical contacts of the at least one pressure switch, and reduce the speed of the induced draft blower below the make point speed such that: (a) the induced draft blower operates between the make point speed and the break point speed, and (b) the electrical contacts of the at least one pressure switch remain closed.

In yet another aspect, the present disclosure relates to a method of manufacturing a high efficiency gas furnace comprising a furnace controller, an induced draft blower, and at least one pressure switch. The method includes connecting the induced draft blower to a furnace controller, connecting an input contact of the at least one pressure switch to an output port of the furnace controller that supplies power to the at least one pressure switch, and connecting an output contact of the at least one pressure switch to an input port of the furnace controller. Further, the method includes connecting the output terminal of an electrical relay to a gas valve, connecting the input terminal of the electrical relay to the output terminal of a backup electrical relay such that the electrical relay is in a series electrical circuit with the backup electrical relay, and connecting the input terminal of the backup electrical relay to the output port of the furnace controller. The furnace controller is configured to operate the induced draft blower at or close to a lowest speed that is needed to keep electrical contacts of the at least one pressure switch closed in response to receiving a heat call. The lowest speed that is needed to keep the electrical contacts of the at least one pressure switch closed is below a make point speed of the induced draft blower at which the electrical contacts of the at least one pressure switch close when the gas furnace is operating at a steady-state heating condition, but above a break point speed of the induced draft blower at which the electrical contacts of the at least one pressure switch open when the gas furnace is operating at a steady-state heating condition.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1A:
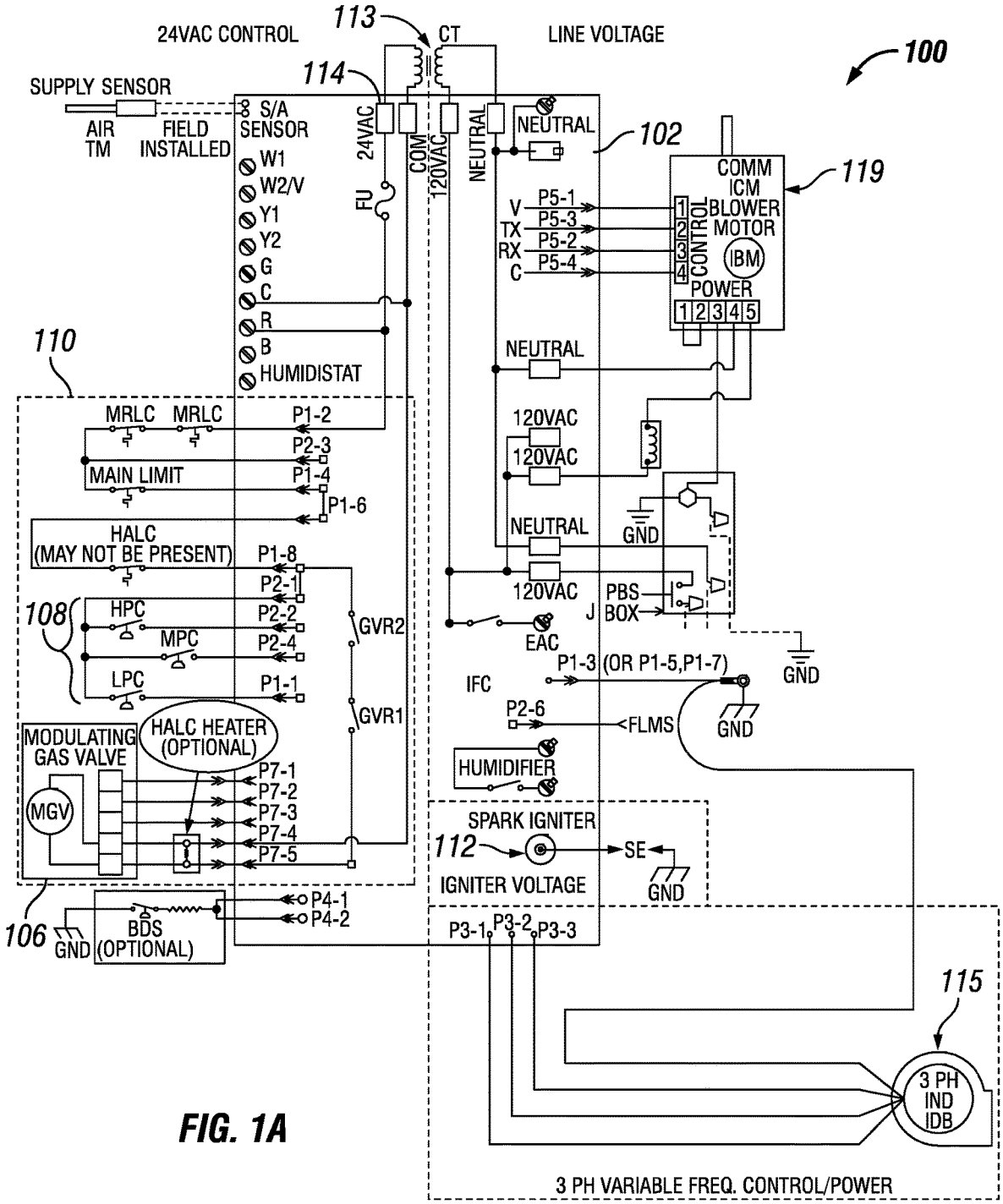
FIGS. 1A and 1B (collectively 'FIG. 1') is a schematic diagram of a high efficiency modulating gas furnace (herein 'gas furnace'), in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes a high efficiency modulating gas furnace (herein 'high efficiency gas furnace') where the electrical contacts of each pressure switch (herein 'pressure switch contacts') are removed from a series electrical circuit controlling a gas valve of the high efficiency gas furnace. Instead, in the high efficiency gas furnace, the pressure switch contacts are connected to an input port of a furnace controller that controls the operation of the gas valve such that the gas valve is not de-energized when the pressure switch opens due to transient conditions.

Removing the pressure switch contacts from a series connection with the gas valve allows the furnace controller of the high efficiency gas furnace to: (a) filter out the transient conditions, such as among other conditions, water temporarily blocking the pressure switch measuring port, wind gusts blowing into the furnace exhaust vent, etc., that cause the pressure switch contacts to open during a combustion cycle; and (b) continue to operate without prematurely ending a combustion cycle. If the pressure switch contacts open for more than a predetermined amount of time, the furnace controller increases the RPM of the induced draft blower to close the pressure switch contacts without ending the current combustion cycle. If the pressure switch contacts close and remain closed for a predetermined time period upon increasing the RPM of the induced draft blower, the furnace controller may recognize that the pressure switch contacts were opened due to a transient condition and continues to operate without ending a current combustion cycle. However, if the pressure switch contacts do not close, the process of increasing the RPM of the induced draft blower to close the pressure switch contacts is repeated a predetermined number of times. After the repeated attempts to reclose the pressure switch contacts, if the pressure switch contacts remain open, the furnace controller takes necessary action based on the type of pressure switch. For example, if the pressure switch is a low heat pressure switch that is associated with a low firing rate mode of operation, then, the furnace controller will shut down the combustion cycle. If the pressure switch is a high heat pressure switch or a medium heat pressure switch associated with a high firing rate and a medium firing rate mode of operation, respectively, the furnace controller may drop down the firing rate of the high efficiency gas furnace to continue operating at a medium firing rate or low firing rate or shut down the combustion cycle.

In addition to filtering out the transient conditions, removing the pressure switch contacts from a series connection with the gas valve allows the furnace controller of the high efficiency gas furnace to operate the induced draft blower at or close to a lowest RPM that is needed to keep the pressure switch contacts of a pressure switch closed. In other words, removing the pressure switch contacts from a series connection with the gas valve eliminates the need to operate the induced draft blower at an increased RPM to overcome the transient condition. Allowing the induced draft blower to operate at the lowest RPM possible to keep the pressure switch contacts closed increases the amount of time that a given volume of combusted air will reside in the heat exchanger of the gas furnace before it is exhausted, maximizing thermal heat transfer and increasing the efficiency of the high efficiency gas furnace above other conventional gas furnaces.

The minimum RPM at which the induced draft blower can operate to keep the pressure switch closed is determined through a calibration sequence. Once the furnace is installed in the application with all venting attached, the controller can increase the RPM of the induced draft blower slowly until the pressure switch closes. Then the RPM of the induced draft blower is reduced until the pressure switch opens. There is a difference in the pressures at which each pressure switch opens and closes due to a hysteresis property of the pressure switches. This in turn results in a difference in the RPM of the induced draft blower at which the pressure switches close and open. The RPMs at which each pressure switch opens and closes is learned and stored in memory of the controller for use during any new combustion sequence. The induced draft blower may be operated at a RPM below which a pressure switch closes but above which the pressure switch opens to maximize the efficiency of the high efficiency gas furnace within the given installation.

It is noted that even though a modulating gas furnace is described herein, the example embodiments of the present disclosure can be applied to any other appropriate gas furnaces where the pressure switch of the gas furnace is connected in series with a gas valve (or a relay controlling the gas valve). Further, it is noted that the term efficiency as used herein refers to thermal and/or combustion efficiency without departing from a broader scope of the present disclosure.

Furthermore, it is noted that the induced draft blower may include a fan that is driven by a motor (e.g., inducer motor), and the term 'RPM of an induced draft blower' as used herein may generally refer to a rotational speed of the motor of the induced draft blower that controls the fan to draw in combustion air. Accordingly, in the present disclosure, the terms 'RPM of an induced draft blower' and 'speed of the induced draft blower' refer to the rotational speed of the motor that drives the fan of the induced draft blower and may be used interchangeably without departing from a broader scope of the present disclosure. That is, the term 'speed of the induced draft blower' as used herein may refer to the rotational speed of the induced motor of the induced draft blower that controls the induced fan of the induced draft blower, where the rotational speed is measured in revolutions per minute (RPM).

Example embodiments of the high efficiency gas furnace will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the high efficiency gas furnace may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the present disclosure can be located in any type of environment (e.g., warehouse, attic, garage, storage, mechanical room, basement) for any type (e.g., commercial, residential, industrial) of user. High efficiency gas furnaces used with example embodiments can include both electric and/or fuel fired gas furnaces that can be used for one or more of any number of processes.

Terms such as "first", "second", "third", and "within", etc., are used merely to distinguish one component (or part of a component or state of a component) from another. Such terms are not meant to denote a preference or a particular orientation, and are not meant to limit embodiments of high efficiency gas furnaces. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Turning now to the figures, example embodiments of a high efficiency modulating gas furnace will be described in connection with FIGS. 1-12. In particular, the schematics of the high efficiency modulating gas furnace will be described in connection with FIGS. 1-2; and example operations of the high efficiency modulating gas furnace will be described in connection with FIGS. 3-11.

Figure 1B:
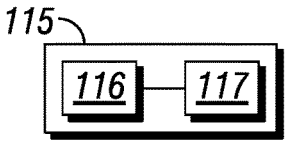
Figure 2:
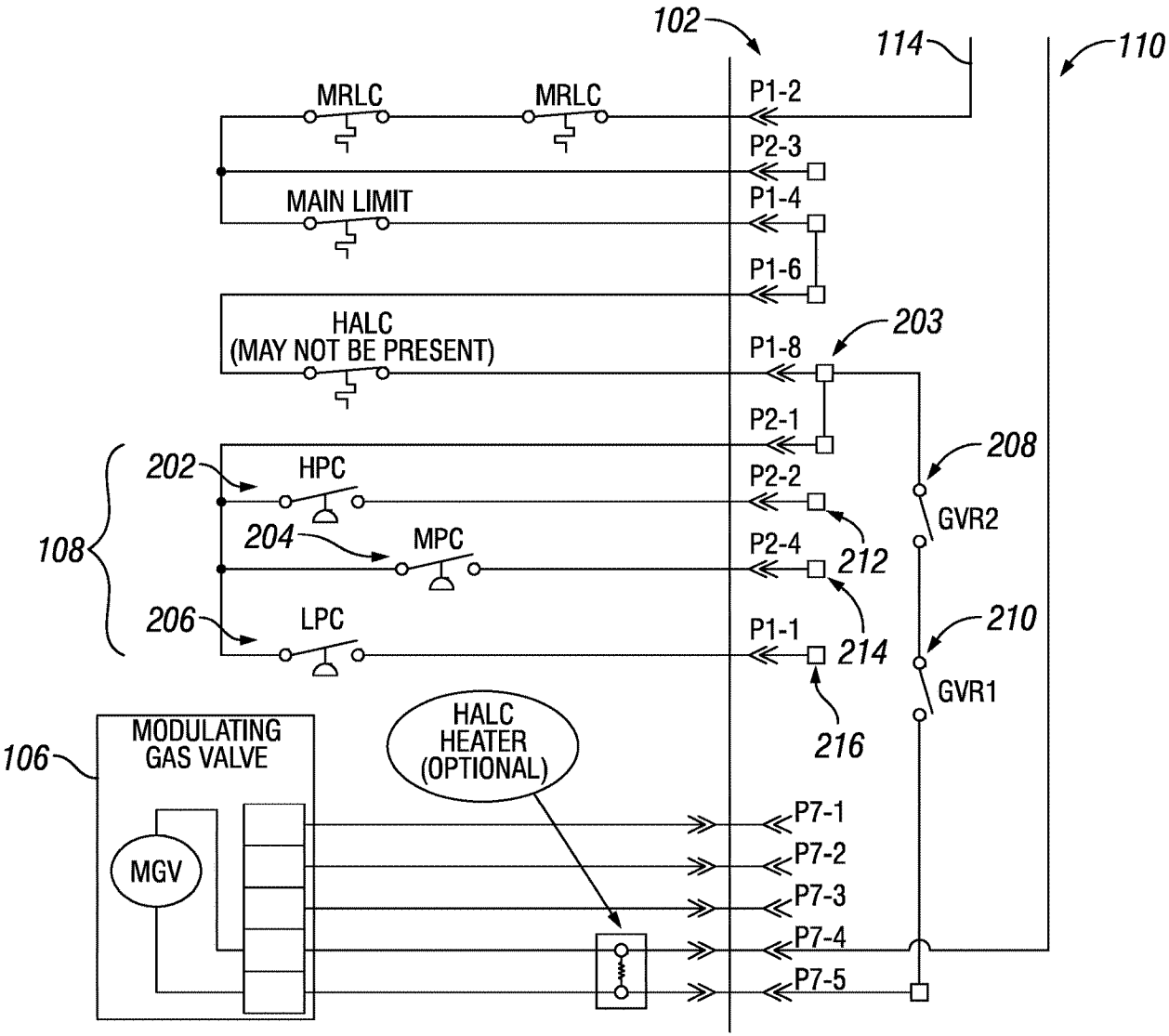
FIG. 2 is an enlarged view of a portion of the schematic diagram of the gas furnace of FIG. 1 that shows how the pressure switches of the gas furnace are no longer in series with the gas valve, in accordance with example embodiments of the present disclosure.

Turning to FIGS. 1-2, an example high efficiency modulating gas furnace 100 (herein 'gas furnace 100') may include a furnace controller 102 that is communicatively and electrically coupled to one or more components of the gas furnace 100. The furnace controller 102 receives input signals from and sends output control signals to the one or more components based on the received input signals to control the one or more components and the operations of the gas furnace 100. The one or more components of the gas furnace 100 may include, but are not limited to, a modulating gas valve 106, an induced draft blower 115, a pressure switch assembly 108, an igniter assembly 112, an electrical relay 210, and a backup electrical relay 208. One of ordinary skill in the art can understand and appreciate that in addition to the components described above, the gas furnace 100 may include many other additional components such as thermostats, an air circulator blower 119, heat exchangers, etc. However, said additional components are not described herein to avoid obscuring the features that are associated with maximizing the efficiency of the gas furnace 100.

The modulating gas valve 106 (herein 'gas valve 106') is configured to regulate the amount of combustion fuel that is released for combustion based on the firing rate at which the gas furnace operates. For example, if the gas furnace operates at a high firing rate, e.g., 70%-100%, then, more combustion fuel may be released by the gas valve 106 than when the gas furnace operates at a medium firing rate, e.g., 50%-65% or a low firing rate, e.g., 40%.

Further, the induced draft blower 115 controls the amount of combustion air that is drawn into the gas furnace and mixed with the combustion fuel. The induced draft blower 115 may include an inducer motor 116 that is electrically coupled to the furnace controller 102 and mechanically coupled to an inducer fan 117. The induced draft blower 115 may be driven in response to RPM control signals that are generated by the furnace controller 102, in response to the states of one or more pressure switches of the pressure switch assembly 108 and/or in response to a call-for-heat signal (herein 'heat call') received from a thermostat in a space that is to be heated. The pressure switches of the pressure switch assembly 108 are configured to confirm proper operation of the induced draft blower 115 of the gas furnace 100. The pressure switch assembly 108 may include three pressure switches: a high-heat pressure switch 202, a medium-heat pressure switch 204, and a low-heat pressure switch 206 that are associated with different operation modes of the gas furnace 100. For example, the high-heat pressure switch 202 may be associated with a high-heat demand mode where the gas furnace 100 operates at a high firing rate to satisfy a high heat demand. Similarly, the medium-heat pressure switch 204 and the low-heat pressure switch 206 may be associated with a medium-heat demand mode where the gas furnace 100 operates at a medium firing rate to satisfy a medium heat demand, and a low-heat demand mode where the gas furnace 100 operates at a low firing rate to satisfy the low heat demand, respectively. Even though the present disclosure describes a gas furnace that has three pressure switches 202-206 associated with three modes of operation, one of ordinary skill in the art can understand and appreciate that in other example embodiments, the gas furnace 100 may have fewer or more number of pressure switches and corresponding firing rate modes of operation without departing from a broader scope of the present disclosure.

As illustrated in FIGS. 1 and 2, the modulating gas valve 106 and the pressure switches 202-206 may be coupled to the controller 102. In conventional gas furnaces, to meet safety standards, the low pressure switch 206 is connected in a series electrical circuit with the electrical relay 210 that controls the gas valve 106 such that when the low pressure switch 206 opens, the gas valve 106 is de-energized and the combustion cycle is shut down. However, in the gas furnace 100 of the present disclosure, the pressure switches 202-206 are not connected in a series electrical circuit with the gas valve 106. Instead, as illustrated in FIGS. 1 and 2, a first terminal (herein 'input contact') of each pressure switch 202-206 is coupled to a port 203 of the furnace controller 102 which in turn is coupled to a power source 113 and provides an energizing signal, e.g., 24 V power supply, to the pressure switches 202-206; while a second terminal (herein 'output contact') of each pressure switch 202-206 is coupled to respective input ports 212-216 of the furnace controller 102.

In conventional gas furnaces, the low pressure switch 206 is connected in series to the electrical relay 210 and operates as a backup electrical contact to the electrical relay 210 that controls the gas valve 106 to meet safety standards. In the gas furnace 100 of the present disclosure, since the low pressure switch 206 is no longer connected in series to the electrical relay 210, safety standards are met by providing a dedicated backup electrical relay 208 that is connected in series with the electrical relay 210 such that the backup electrical relay 208 can control the gas valve 106 when the electrical relay 210 does not work. For example, when the electrical relay 210 is fused closed, the gas valve 106 can be controlled by opening or closing the backup electrical relay 208. In particular, as illustrated in FIGS. 1 and 2, an input terminal of the backup electrical relay is connected to the port 203 of the furnace controller 102 that provides an energizing signal for the backup electrical relay 208, while the output terminal of the backup electrical relay 208 is connected to the input terminal of the electrical relay 210 that controls the energizing and de-energizing of the gas valve 106 such that the backup electrical relay 208 and the electrical relay 210 are connected in series. Further, the output terminal of the electrical relay 210 is connected to an input terminal of the gas valve 106.

The furnace controller 102 of the gas furnace 100 controls the backup electrical relay 208, the electrical relay 210, and the gas valve 106 based on a state of one or more of the pressure switches 202-206 that is determined using the input signal received from the pressure switches 202-206 at the input ports 212-216. For example, if the furnace controller 102 determines that the low-heat pressure switch 206 is closed, then the furnace controller 102: (a) closes the backup electrical relay 208 and the electrical relay 210 to energize the gas valve 106, and (b) provides a control signal to the gas valve 106 to control the amount of combustion fuel outputted by the gas valve 106 for a low firing rate operation of the gas furnace.

As described above, since the pressure switches 202-206 of the gas furnace 100 are not connected in series to the electrical relay 210 that controls the energizing and de-energizing of the gas valve 106, the gas valve 106 of the gas furnace 100 is not automatically de-energized as soon as pressure switch contacts of any one of the pressure switches 202-206 opens. This allows the furnace controller 102 to continue operating the gas furnace 100 without shutting down the combustion cycle by various mechanisms, such as, but not limited to, increasing the RPM of the induced draft blower 115 to close the pressure switch contacts, reducing or increasing the firing rate of the gas furnace, etc.

That is, the gas furnace of the present disclosure reduces nuisance resets of the combustion cycles and improves and/or maximizes the efficiency of the gas furnace by allowing the induced draft blower 115 to operate at the lowest RPM possible to keep the pressure switches closed, thereby increasing the amount of time that any given volume of combusted air will reside in the heat exchanger before it is exhausted.

The different operations of the gas furnace will be described in greater detail below in association with FIGS. 3-11. In particular, FIGS. 5-11, which illustrate flowcharts associated with the example operations of the gas furnace, will be described by making reference to FIGS. 3 and 4, as needed.

Although specific operations are disclosed in the flowcharts illustrated in FIGS. 5-11, such operations are only non-limiting examples. That is, embodiments of the present invention are well suited to performing various other operations or variations of the operations recited in the flowcharts. It is appreciated that the operations in the flowcharts illustrated in FIGS. 5-11 may be performed in an order different than presented, and that not all of the operations in the flowcharts may be performed.

All, or a portion of, the embodiments described by the flowcharts illustrated in FIGS. 5-11 can be implemented using computer-readable and computer-executable instructions which reside, for example, in computer-usable media of a computer system, a memory of the furnace controller 102, or like device. As described above, certain processes and operations of the present invention are realized, in one embodiment, as a series of instructions (e.g., software programs) that reside within computer readable memory of a computer system or a memory associated with the furnace controller 102 and are executed by the processor of the computer system or the furnace controller 102. When executed, the instructions cause the computer system or the furnace controller 102 to implement the functionality of the present invention as described below.

Figure 5:
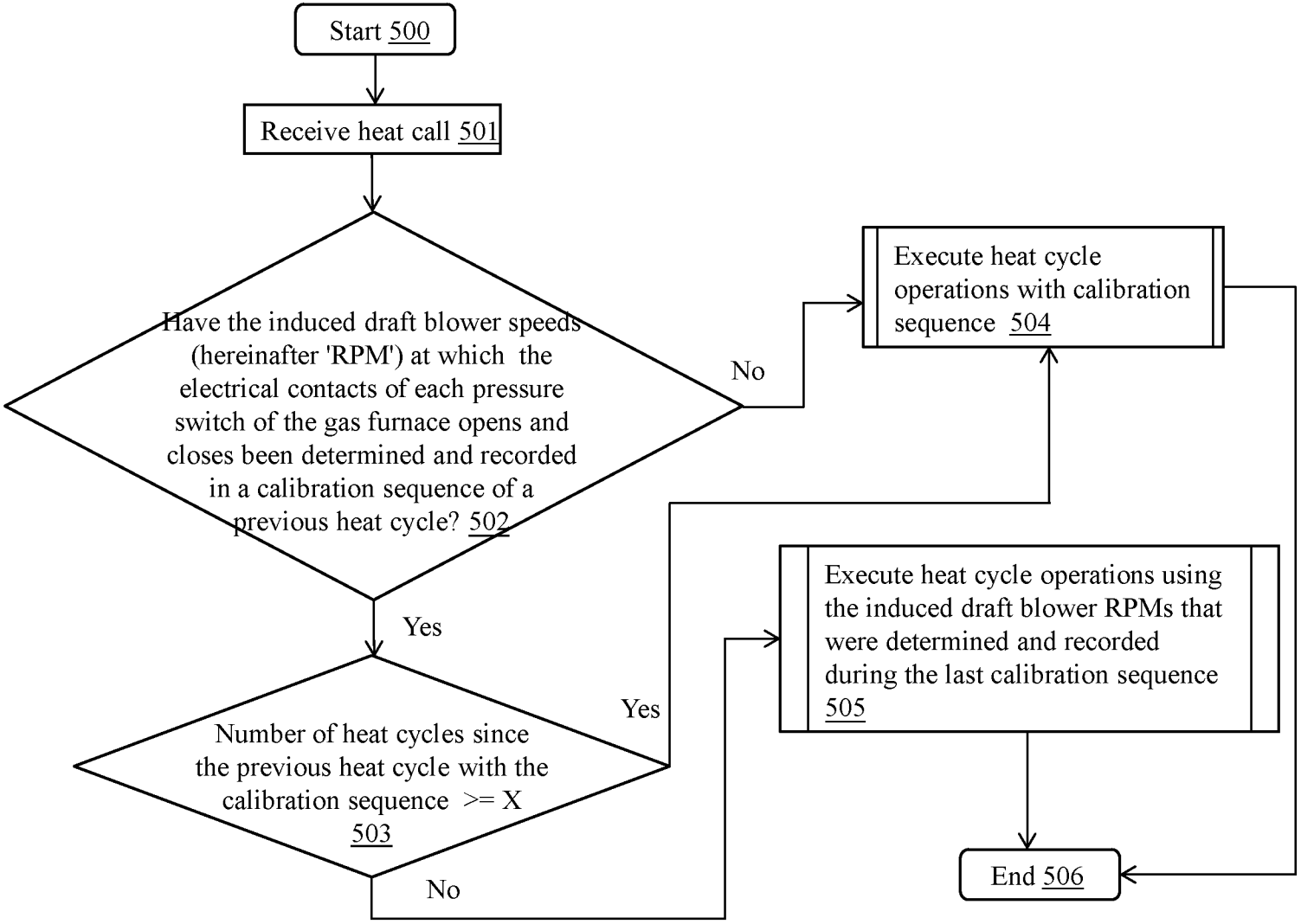
FIG. 5 is a flowchart that illustrates an example operation of the gas furnace of FIG. 1, in accordance with example embodiments of the present disclosure.

Turning to FIG. 5, the operation of the gas furnace 100 begins at step 500 when the thermostat provides a call-for-heat signal (herein 'heat call') to the furnace controller 102. In step 501, the furnace controller 102 receives the heat call from the thermostat that is disposed in an area that is to be heated. Responsive to receiving the heat call, in step 502, the furnace controller 102 determines whether the RPMs of the induced draft blower 115 (hereinafter 'induced draft blower RPM') at which each pressure switch 202-206 closes and opens have been learned and recorded in a calibration sequence 309 of a previous heat cycle. Hereinafter, a heat cycle that includes a calibration sequence 309 may be referred to as a 'calibration heat cycle' 300, while a heat cycle that uses the induced blower RPMs learned and recorded during a calibration sequence of a previous heat cycle may be referred to as a 'non-calibration heat cycle' 400. That is, the non-calibration heat cycle 400 may not include the calibration sequence 309. Further, hereinafter, the pressure at which the pressure switch contacts close and open may be referred to as 'make point' and 'break point', respectively.

If the furnace controller 102 determines that the induced draft blower RPMs associated with the make and break points of each pressure switch 202-206 have not been learned and recorded in a previous calibration heat cycle, then, in step 504, the furnace controller 102 initiates and completes a calibration heat cycle 300. However, if the furnace controller 102 determines that the induced draft blower RPMs associated with the make and break points of each pressure switch 202-206 have been learned and recorded at the furnace controller 102 in a previous calibration heat cycle 300, in step 503, the furnace controller 102 determines whether the number of heat cycles (non-calibration heat cycles) that have been completed since the previous calibration heat cycle is greater than or equal to a predetermined number 'X'. If the furnace controller 102 determines that the number of non-calibration heat cycles that have been completed since the previous calibration heat cycle is greater than or equal to a predetermined number 'X', then, the furnace controller 102 proceeds to step 504 where a new calibration heat cycle 300 is initiated and completed. But, if the furnace controller 102 determines that the number of non-calibration heat cycles that have been completed since the previous calibration heat cycle 300 is less than the predetermined number 'X', then, the furnace controller 102 proceeds to step 505 where the furnace controller 102 initiates and completes a non-calibration heat cycle 400 where the recorded induced draft blower RPMs associated with the make and break points of each pressure switch 202-206 are used to control the induced draft blower 115 during the current non-calibration heat cycle. In other words, the calibration heat cycle 300 is repeated only after X number of heat cycles, e.g., for every 50 or 100 heat cycles there may be one calibration heat cycle. Further, once a calibration heat cycle 300 is completed, any following heat calls are met using non-calibration heat cycles 400 which do not include a calibration sequence, provided X number of heat cycles have been completed as described above. The operation of the gas furnace 100 ends at step 506 after the heat demand associated with the heat call has been satisfied and the heat call has been removed.

Calibration Heat Cycle

The calibration heat cycle 300 of the gas furnace 100 will be described below in greater detail in association with FIGS. 6-9 by making reference to FIG. 3 as needed. As described above, the calibration heat cycle 300 includes a calibration cycle 309 where the RPMs associated with the make and break points of each pressure switch 202-206 are learned and recorded at the furnace controller 102. In particular, the calibration sequence may include a cold calibration sub-sequence 311 and a warm calibration sub-sequence 313. During the cold calibration sub-sequence 311, the furnace controller 102 learns and records the induced draft blower RPMs associated with the make points of each pressure switch 202-206 prior to ignition; and during the warm calibration sub-sequence 313, the furnace controller 102 learns and records the induced draft blower RPMs associated with the make and break points of each pressure switch 202-206 when the operation of the gas furnace reaches a steady-state heating condition after the ignition.

The cold calibration sub-sequence 311 learns and records the induced draft blower RPM at which enough combustion air is drawn in for ignition 324, but not too much that the flame resulting from the ignition 324 is blown out. In other words, the cold calibration sub-sequence 311 provides the proper induced draft blower RPM that is needed for successful ignition 324 of the gas furnace in each heat cycle, which removes any ambiguity regarding the RPM the induced draft blower 115 should be operated for ignition during each heat cycle. If the induced draft blower RPM that is needed for ignition is not known, then, the furnace controller 102 has to operate the induced draft blower 115 at random high RPMs to start ignition, which would not be efficient because the random high RPM at which the induced draft blower 115 is operated may be more than or less than what is needed for ignition. Therefore, learning and recording the induced draft blower RPM that is needed for ignition during the cold calibration sub-sequence 311 allows precise control, and thereby improves efficiency of the gas furnace 100.

Since the density of the air in the gas furnace changes after ignition and combustion of the fuel-air mixture, the induced draft blower RPMs associated with the make and break points of each pressure switch 202-206 during the steady-state heating condition 315 of the gas furnace 100 may differ from the induced draft blower RPMs associated with the make and break points of each pressure switch 202-206 learned during the cold calibration sub-sequence 311 prior to ignition. For example, the induced draft blower RPMs associated with the make and break points of each pressure switch 202-206 during the steady-state heating condition 315 of the gas furnace 100 may be slightly lower than the induced draft blower RPMs associated with the make and break points of each pressure switch 202-206 prior to ignition 324. Therefore, the furnace controller 102 has to perform a warm calibration sub-sequence 313 to learn and record the RPMs associated with the make and break points of each pressure switch 202-206 when the operation of the gas furnace reaches a steady-state heating condition 315 after the ignition 324.

Figure 6A:
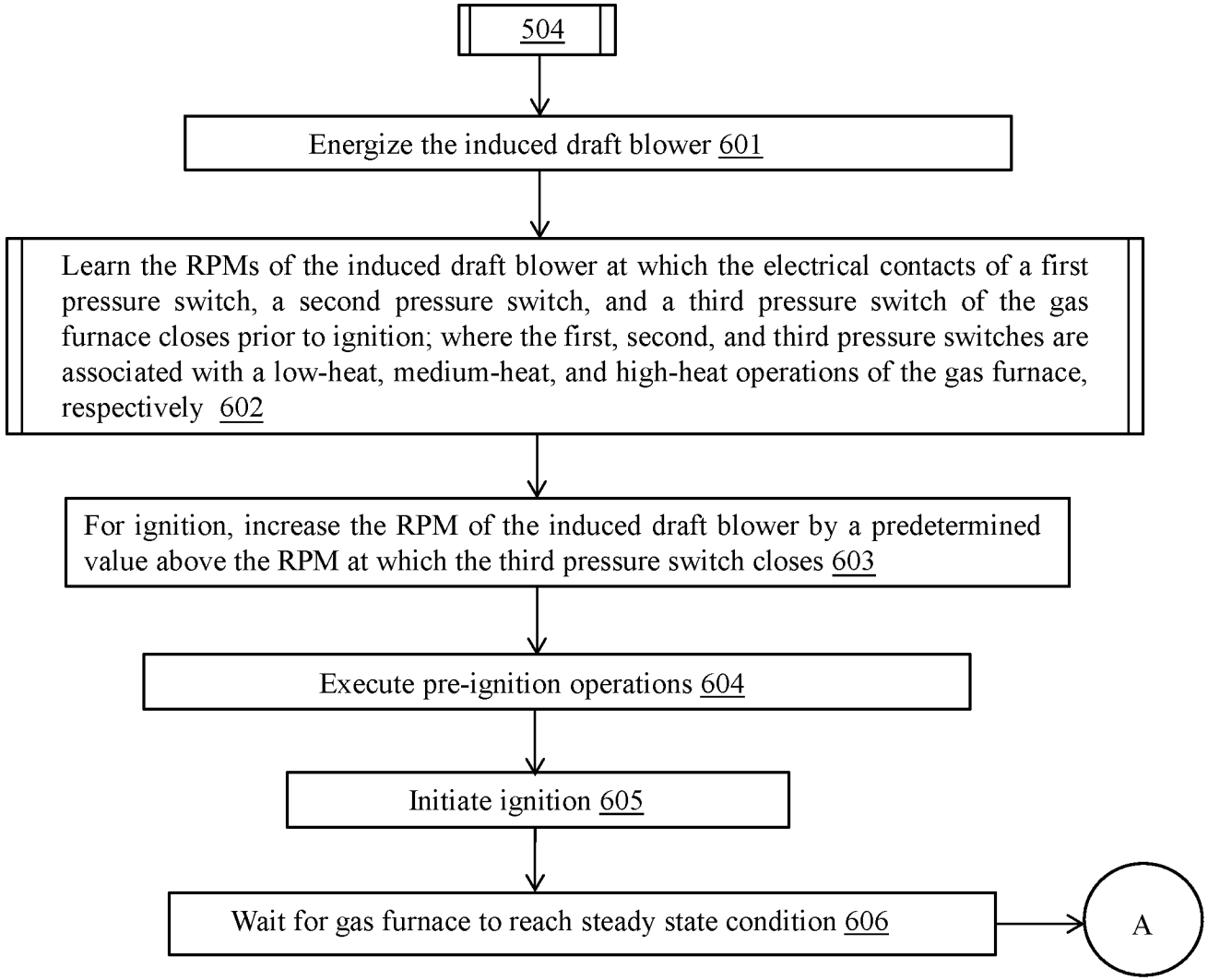
FIGS. 6A-6C (collectively 'FIG. 6') are flowcharts that illustrate an example operation associated with a calibration heat cycle of the gas furnace of FIG. 1, in accordance with example embodiments of the present disclosure.
Figure 6B:
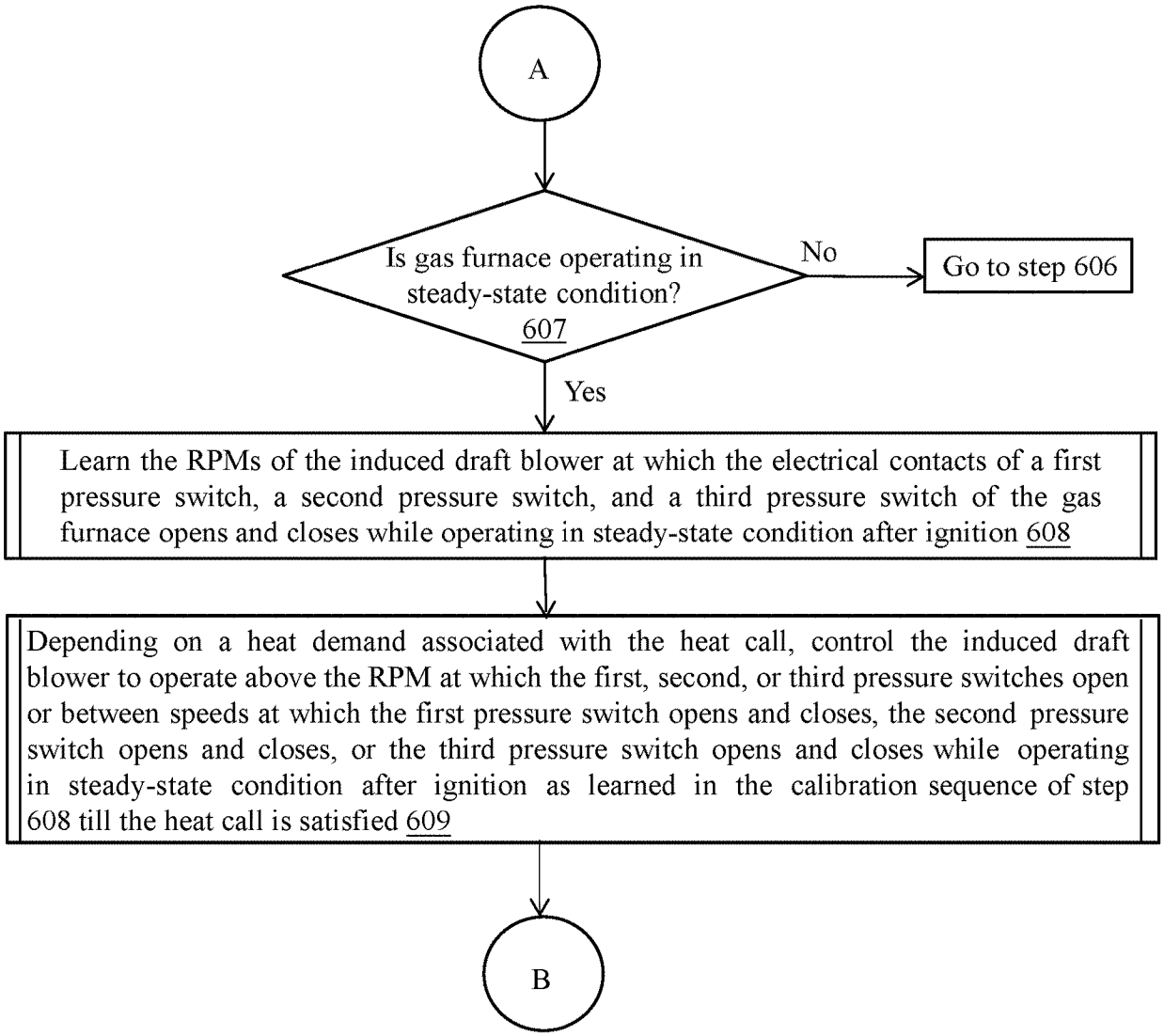
Figure 6C:
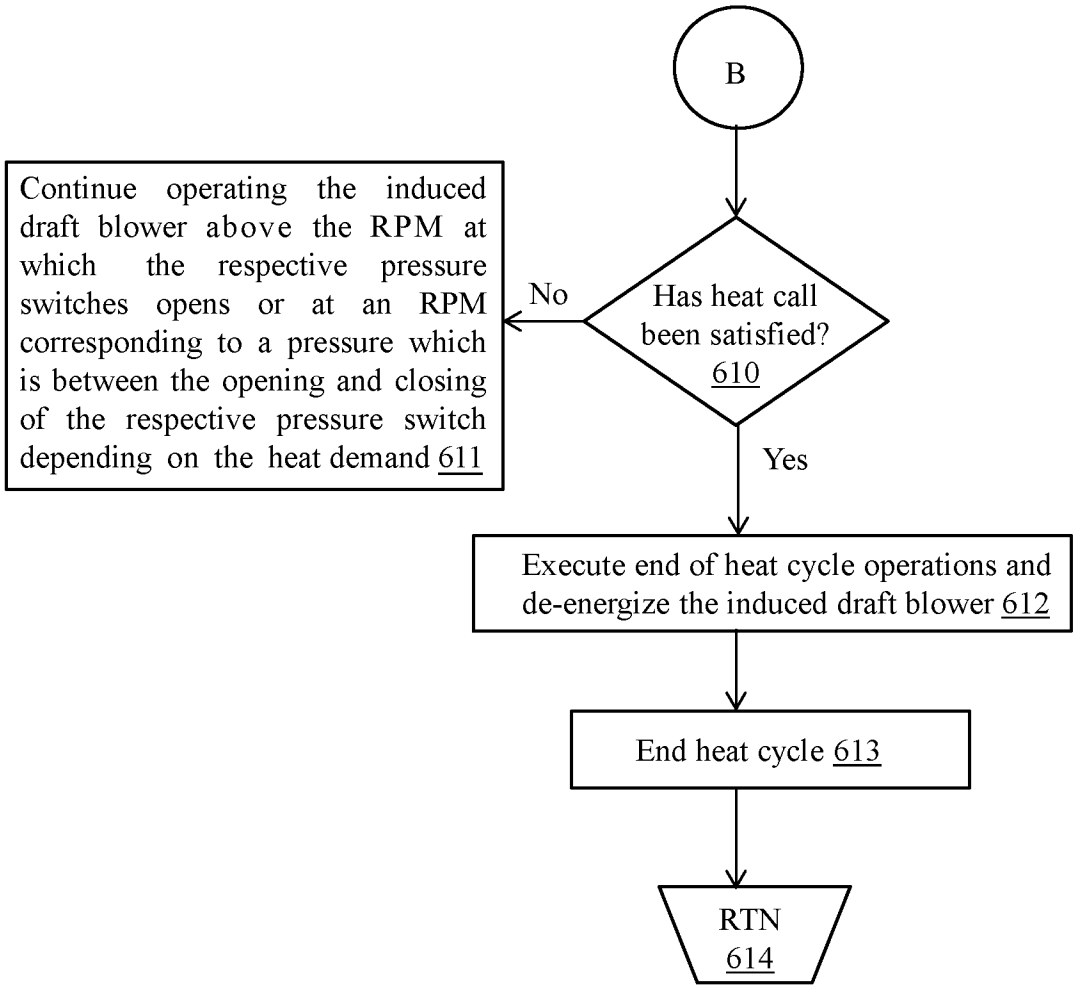

Turning to FIG. 6, this figure is a flowchart that illustrates an operation of the gas furnace during a calibration heat cycle. In operation 601, the furnace controller 102 begins the calibration heat cycle by turning on or energizing the induced draft blower 115. Responsively, in operation 602, the furnace controller 102 proceeds to the cold calibration sub-sequence 311 where the induced draft blower RPMs associated with the make points of each pressure switch 202-206 is learned and recorded at the furnace controller 102 prior to ignition 324 so that an accurate RPM can be determined for ignition 324. The cold calibration sub-sequence is described below in greater detail in association with FIG. 7.

Figure 3:
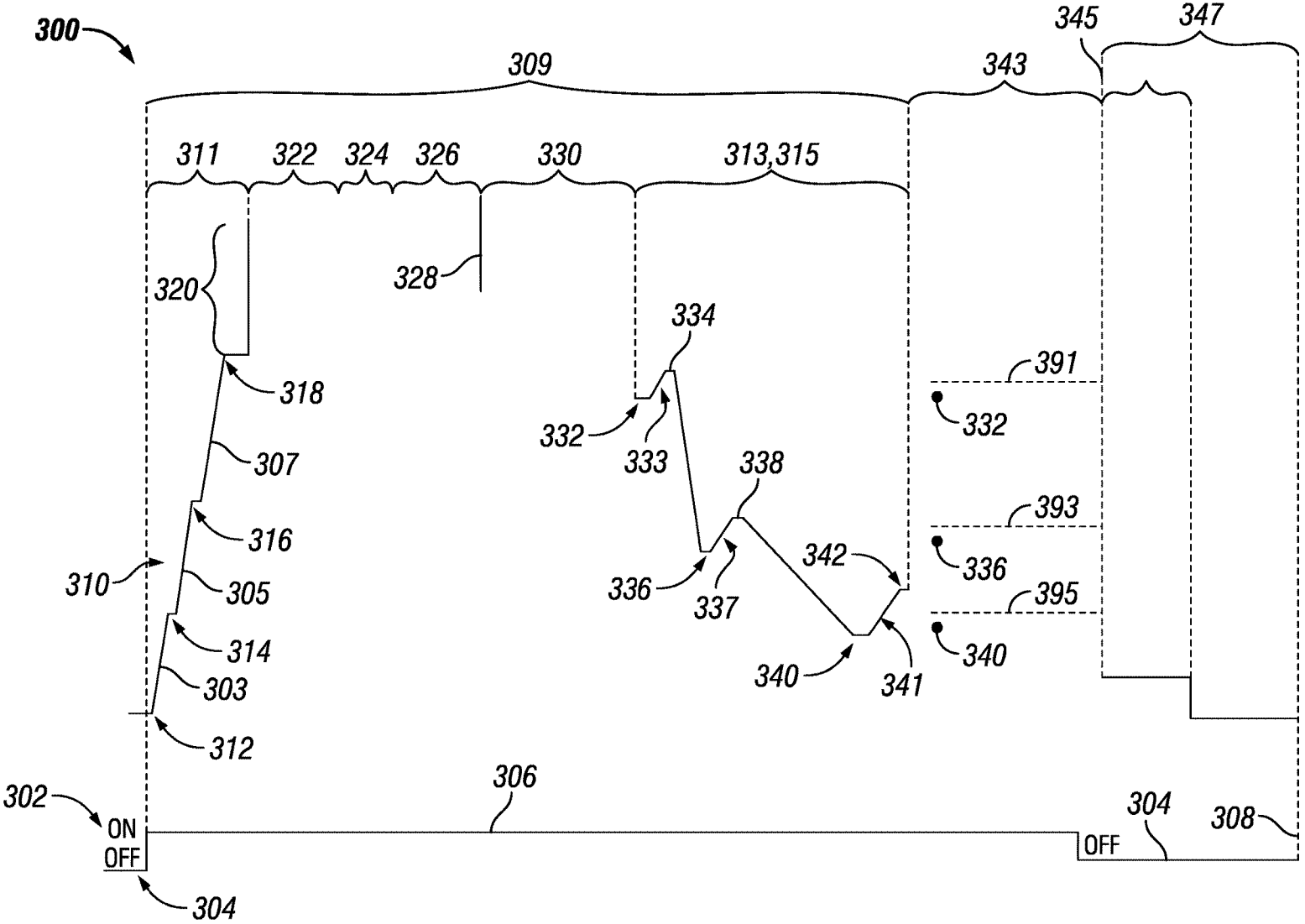
FIG. 3 is a line chart that illustrates a calibration heat cycle of the gas furnace of FIG. 1 with a calibration sequence, in accordance with example embodiments of the present disclosure.
Figure 7:
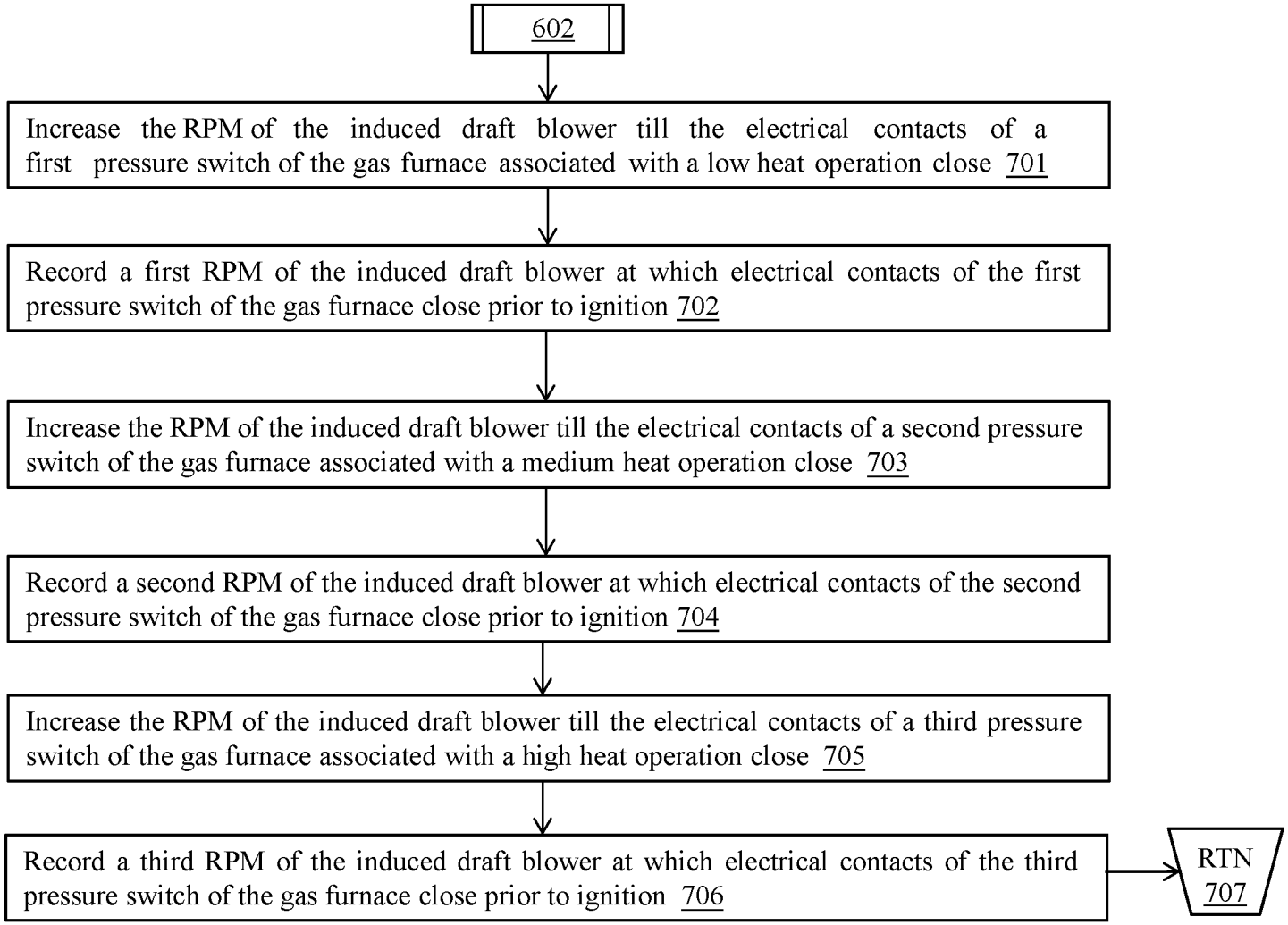
FIG. 7 is a flowchart that illustrates an example operation associated with a cold calibration sub-sequence of the gas furnace of FIG. 1 prior to an ignition, in accordance with example embodiments of the present disclosure.

Turning to FIG. 7, once the induced draft blower 115 is energized, in operation 601, the cold calibration sub-sequence begins by gradually increasing the RPM of the induced draft blower 115 as illustrated by ramp 303 in FIG. 3 till a make point of the low-heat pressure switch 206 is reached, i.e., the pressure switch contacts of the low-heat pressure switch 206 are closed. Once the induced draft blower RPM at which the pressure switch contacts of the low-heat pressure switch 206 close is identified, in operation 702, the identified induced draft blower RPM is recorded at the furnace controller 102 as a first induced draft blower RPM 314 associated with the make point of the low-heat pressure switch 206. Hereinafter, the first induced draft blower RPM 314 associated with the make point of the low-heat pressure switch 206 may be referred to as the cold calibration make point RPM 314 of the low-heat pressure switch 206. Responsive to identifying and recording the cold calibration make point RPM 314 of the low-heat pressure switch 206, the furnace controller 102 proceeds to operation 703, where the RPM of the induced draft blower 115 is gradually increased as illustrated by ramp 305 in FIG. 3 till a make point of the medium-heat pressure switch 204 is reached, i.e., the pressure switch contacts of the medium-heat pressure switch 204 are closed. Once the induced draft blower RPM at which the pressure switch contacts of the medium-heat pressure switch 204 close is identified, in operation 704, the identified induced draft blower RPM is recorded at the furnace controller 102 as a second induced draft blower RPM 316 associated with the make point of the medium-heat pressure switch 204. Hereinafter, the second induced draft blower RPM 316 associated with the make point of the medium-heat pressure switch 204 may be referred to as the cold calibration make point RPM 316 of the medium-heat pressure switch 204. Similarly, after identifying and recording the cold calibration make point RPM 316 of the low-heat pressure switch 206, the furnace controller 102 proceeds to operation 705, where the RPM of the induced draft blower 115 is gradually increased as illustrated by ramp 307 in FIG. 3 till a make point of the high-heat pressure switch 202 is reached, i.e., the pressure switch contacts of the high-heat pressure switch 202 are closed. Once the induced draft blower RPM at which the pressure switch contacts of the high-heat pressure switch 202 close is identified, the identified induced draft blower RPM is recorded as a third induced draft blower RPM 318 associated with the make point of the high-heat pressure switch 202. Hereinafter, the third induced draft blower RPM 318 associated with the make point of the high-heat pressure switch 202 may be referred to as the cold calibration make point RPM 318 of the high-heat pressure switch 202.

Once the cold calibration sub-sequence is completed and the cold calibration make point RPMs 314-318 of the pressure switches 202-206 are identified and recorded, the furnace controller 102 returns to operation 603 of FIG. 6. Referring back to FIG. 6, in operation 603, for ensuring successful ignition 324, the furnace controller 102 increases the RPM of the induced draft blower 115 by a predetermined value above the cold calibration make point RPM 318 of the high-heat pressure switch 202. In other words, a buffer RPM 320 may be added to cold calibration make point RPM 318 of the high-heat pressure switch 202 as illustrated in FIG. 3 to ensure successful ignition. For example, the furnace controller 102 may increase the RPM of the induced draft blower 115 by an incremental rpm above the cold calibration make point RPM 318 of the high-heat pressure switch 202. The buffer RPM 320 accounts for transient conditions, furnace size, vent length, etc., to ensure a successful ignition 324. In some example embodiments, the induced draft blower 115 may be operated without the buffer RPM for ignition, i.e., the induced draft blower 115 may be operated at the cold calibration make point RPM 318 of the high-heat pressure switch 202 for ignition. Hereinafter the sum of the buffer RPM and the cold calibration make point RPM 318 of the high-heat pressure switch 202 may be referred to as the 'ignition RPM'.

In one example embodiment, the buffer RPM 320 that is to be added to the cold calibration make point RPM 318 of the high-heat pressure switch 202 is automatically determined by the furnace controller 102 based on various factors, such as size of the furnace, vent lengths, etc. Alternatively, in other example embodiments, the buffer RPM 320 may be stored in the furnace controller 102 during design. In yet another example embodiment, the buffer RPM 320 may be user-defined and inputted prior to a heat cycle or during the heat cycle.

In either case, once the RPM of the induced draft blower 115 is increased by a predetermined value (buffer RPM 320) above the cold calibration make point RPM 318 of the high-heat pressure switch 202, in operation 604, the furnace controller 102 initiates and completes pre-ignition operations, such as the pre-purge sequence 322 as illustrated in FIG. 3 where any combustion gas from a previous heat cycle is removed from heat exchanger tubes (not shown) of the gas furnace 100 to ensure that the heat exchanger tubes would receive clean and fresh combustion gases in the current calibration heat cycle. Responsive to completing the pre-purge sequence 322 in operation 604, the furnace controller 102 proceeds to operation 605 where the ignition sequence 324 is initiated and completed as illustrated in FIG. 3. In particular, in operation 605, the furnace controller 102 energizes the gas valve 106 and the igniter 112 (spark igniter) to burn the mixture of the combustion air drawn in by the induced draft blower 115 and the combustion fuel released by the gas valve 106 which in turn generates hot combustion gases that are passed through the heat exchanger tubes of the gas furnace 100 to heat the heat exchanger tubes. Further, in operation 605, the furnace controller 102 initiates and completes a blower delay sequence 326 after which the air circulating blower is energized 328 as illustrated in FIG. 3 to blow air over the heat exchangers and through the registers into the space that is to be heated. The blower delay sequence 326 provides time for the heat exchanger tubes to warm up with the hot combustion gases before air is blown over the heat exchangers by the air circulating blower, which in turn prevents cold air from being blown into the space that is to be heated.

After the ignition sequence 324 is completed and the air circulating blower is energized, in operations 606 and 607, the furnace controller 102 waits for a pre-set time period 330 to allow the gas furnace 100 to reach a steady-state heating condition 315 or equilibrium where the temperature and flow of the combustion gases through the heat exchanger tubes are not changing beyond a threshold limit. When the furnace controller 102 determines steady-state heating condition 315 is reached, in operation 608, the furnace controller 102 proceeds to the warm calibration sub-sequence 313 where the induced draft blower RPMs associated with the make and break points of each pressure switch 202-206 are learned and recorded at the furnace controller 102 during the steady-state heating condition after ignition because the air through the gas furnace 100 is much hotter and has more moisture. For maximum efficiency and to prevent nuisance resets/trips of the pressure switches 202-206, the calibration must be performed again at steady state conditions with gas burning and the air circulating blower operating. The warm calibration sub-sequence is described below in greater detail in association with FIG. 8.

Figure 8A:
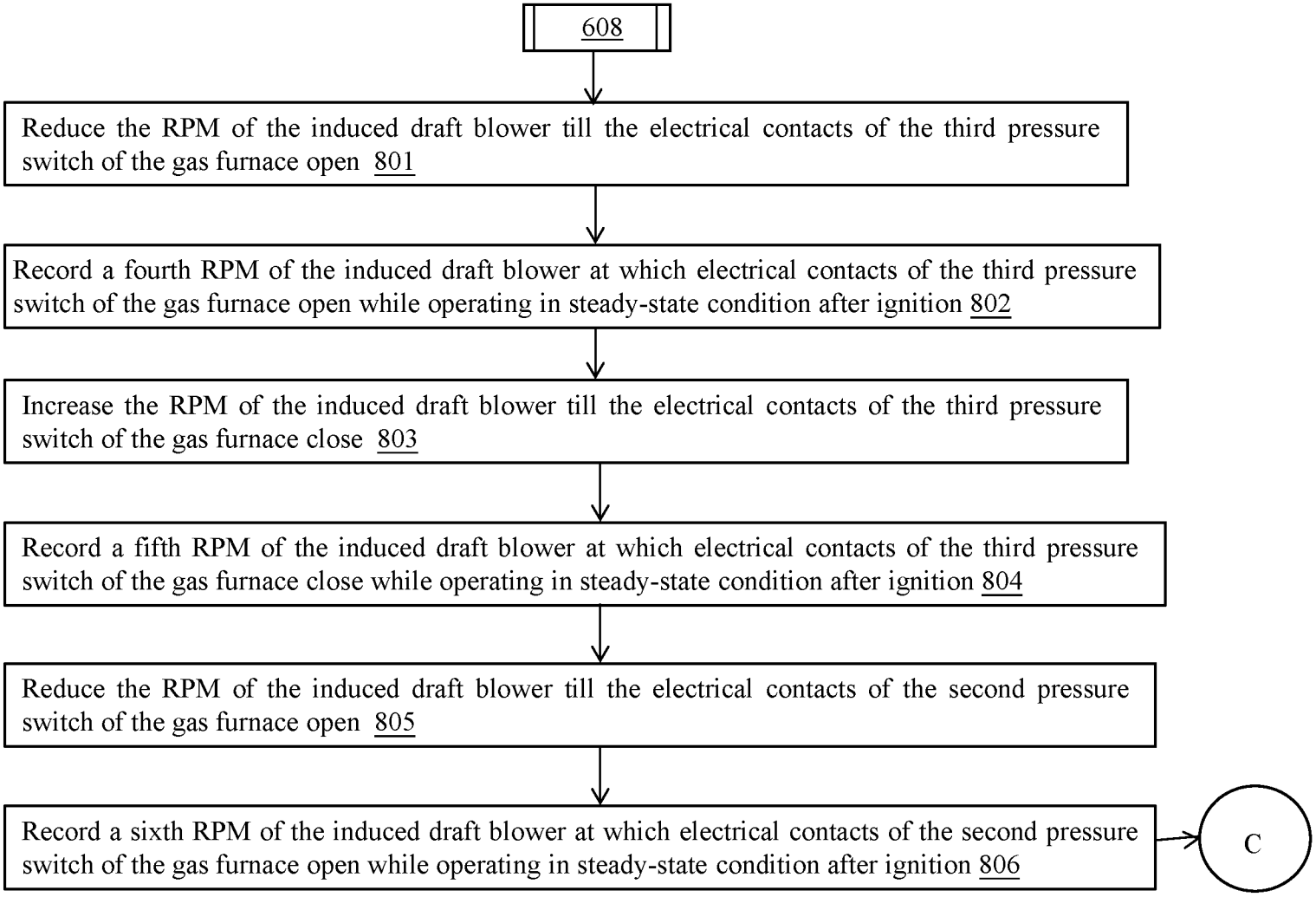
FIGS. 8A-8B (collectively 'FIG. 8') are flowcharts that illustrate an example operation associated with a warm calibration sub-sequence of the gas furnace of FIG. 1 after the gas furnace reaches a steady-state condition, in accordance with example embodiments of the present disclosure.
Figure 8B:
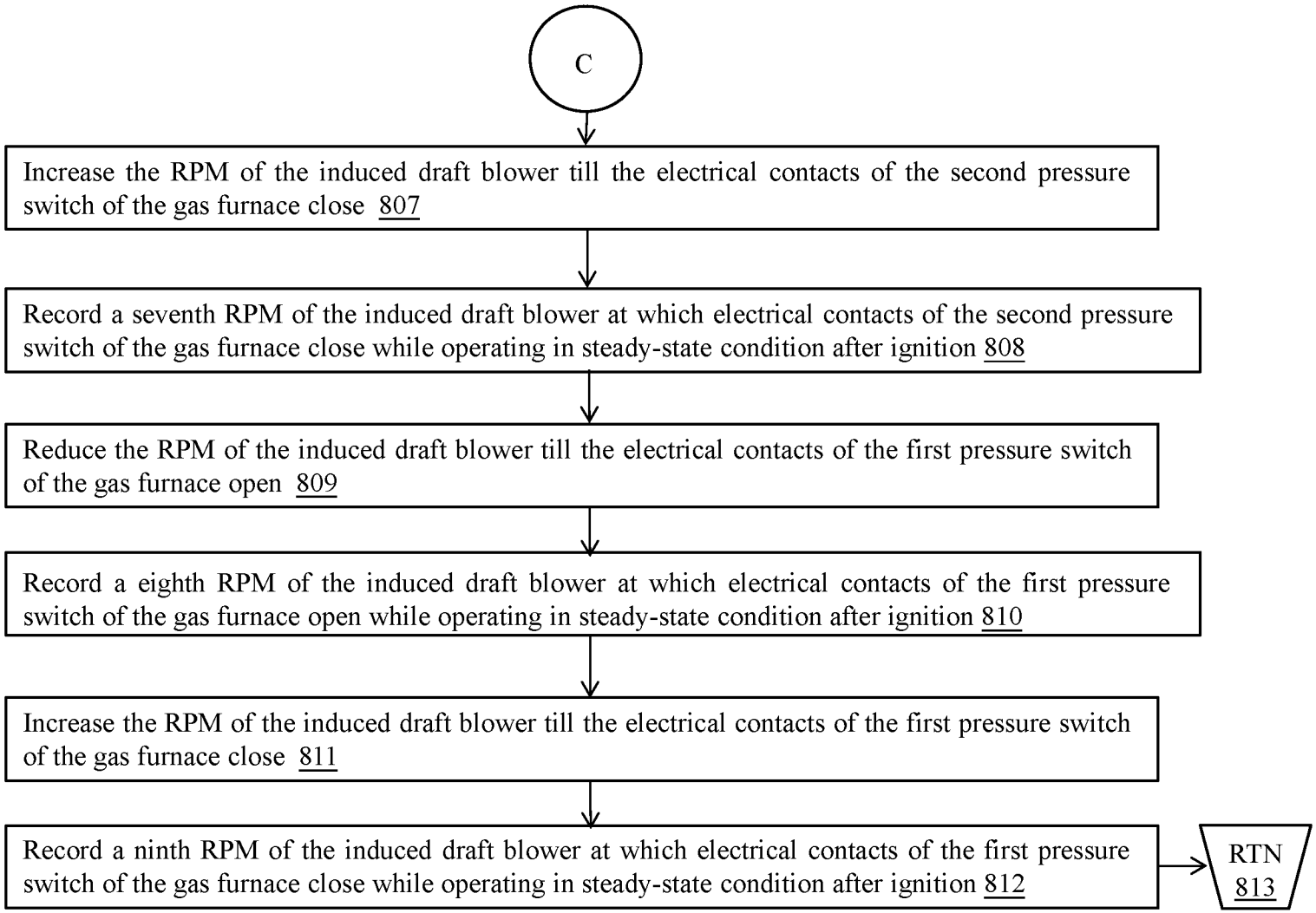

Turning to FIG. 8, once the steady-state heating condition is reached, in operation 801, the warm calibration sub-sequence begins by reducing the RPM of the induced draft blower 115 from the ignition RPM to a RPM at which a break point of the high-heat pressure switch 202 is reached, i.e., the pressure switch contacts of the high-heat pressure switch 202 are opened. Once the induced draft blower RPM at which the pressure switch contacts of the high-heat pressure switch 202 open is identified, in operation 802, the identified induced draft blower RPM is recorded at the furnace controller 102 as a fourth induced draft blower RPM 332 associated with the break point of the high-heat pressure switch 202. Hereinafter, the fourth induced draft blower RPM 332 associated with the break point of the high-heat pressure switch 202 may be referred to as the warm calibration break point RPM 332 of the high-heat pressure switch 202. Responsive to identifying and recording the warm calibration break point RPM 332 of the high-heat pressure switch 202, in operation 803, the furnace controller 102 gradually increases the RPM of the induced draft blower 115 as illustrated by the ramp 333 in FIG. 3 till a make point of the high-heat pressure switch 202 is reached, i.e., the pressure switch contacts of high-heat pressure switch 202 are closed. Once the induced draft blower RPM at which the pressure switch contacts of the high-heat pressure switch 202 close is identified, in operation 804, the identified induced draft blower RPM is recorded at the furnace controller 102 as a fifth induced draft blower RPM 334 associated with the make point of the high-heat pressure switch 202. Hereinafter, the fifth induced draft blower RPM 334 associated with the make point of the high-heat pressure switch 202 may be referred to as the warm calibration make point RPM 334 of the high-heat pressure switch 202.

After identifying and recording the warm calibration make point and break point RPMs (332, 334) of the high-heat pressure switch 202, the furnace controller 102 proceeds to operation 805 where the RPM of the induced draft blower 115 is reduced till a break point of the medium-heat pressure switch 204 is reached, i.e., the pressure switch contacts of the medium-heat pressure switch 204 are opened. Once the induced draft blower RPM at which the pressure switch contacts of the medium-heat pressure switch 204 open is identified, in operation 806, the identified induced draft blower RPM is recorded at the furnace controller 102 as a sixth induced draft blower RPM 336 associated with the break point of the medium-heat pressure switch 204. Hereinafter, the sixth induced draft blower RPM 336 associated with the break point of the medium-heat pressure switch 204 may be referred to as the warm calibration break point RPM 336 of the medium-heat pressure switch 204. Responsive to identifying and recording the warm calibration break point RPM 336 of the medium-heat pressure switch 204, in operation 807, the furnace controller 102 gradually increases the RPM of the induced draft blower 115 as illustrated by the ramp 337 in FIG. 3 till a make point of the medium-heat pressure switch 204 is reached, i.e., the pressure switch contacts of the medium-heat pressure switch 204 are closed. Once the induced draft blower RPM at which the pressure switch contacts of the medium-heat pressure switch 204 close is identified, in operation 808, the identified induced draft blower RPM is recorded at the furnace controller 102 as a seventh induced draft blower RPM 338 associated with the make point of the medium-heat pressure switch 204. Hereinafter, the seventh induced draft blower RPM 338 associated with the make point of the medium-heat pressure switch 204 may be referred to as the warm calibration make point RPM 338 of the medium-heat pressure switch 204.

Similarly, in operations 809-812, the warm calibration make point and break point RPMs (340, 342) of the low-heat pressure switch 202 are determined by first reducing the RPM of the induced draft blower 115 to determine the warm calibration break point RPM 340 of the low-heat pressure switch 202 and then gradually increasing the RPM of the induced draft blower 115 to determine the warm calibration make point RPM 342 of the low-heat pressure switch 202.

It is noted that the pressure switches 202-206 may have some hysteresis. That is, the pressure needed to close the pressure switch contacts of a pressure switch is slightly greater than the pressure needed to open the pressure switch contacts of the same pressure switch from the closed condition. Therefore, the induced draft blower RPMs at which the pressure switch contacts of each of the pressure switches 202-206 opens and closes may be different as illustrated in FIG. 3.

Once the warm calibration sub-sequence is completed and the warm calibration make point RPMs (334, 338, and 342) and break point RPMs (332, 336, and 340) of the pressure switches 202-206 are identified and recorded, the furnace controller 102 returns to operation 609 of FIG. 6. In conventional gas furnaces, if the induced draft blower RPM is reduced to a break point of the low pressure switch, then, the gas valve would switch off which in turn kills the flame and shuts down the calibration heat cycle prematurely. So, in conventional gas furnaces, a measurement of warm calibration make point RPMs of the low pressure switch is not possible during the heat cycle. Instead, such measurements could only be made after the heat cycle so that the heat cycle is not shut down before meeting the heat demand or before the heat call is removed due to opening of the pressure switches during calibration. However, a measurement of the make point RPMs of the low pressure switch after the heat cycle would not be useful because of the different air density when there is not combustion. In other words, conventional gas furnaces cannot calibrate in the low-fired state, i.e., after equilibrium is reached and while the flame exists. The gas furnace 100 of the present disclosure allows the calibration sequence to be performed in all fired states while the flame exists, i.e., during the heat cycle after a steady-state heating condition is reached which is an improvement over conventional gas furnaces.

Referring back to FIG. 6, once the calibration sequence 309, i.e., the cold and warm calibration sub-sequences (311, 313), are completed, in operation 609, the furnace controller 102 transitions into a heating sequence where the gas furnace 100 is operated to satisfy the heat demand associated with the heat call received from the thermostat in operation 501 of FIG. 5. The heating sequence of operation 608 is described below in greater detail in association with FIG. 9.

Figure 9:
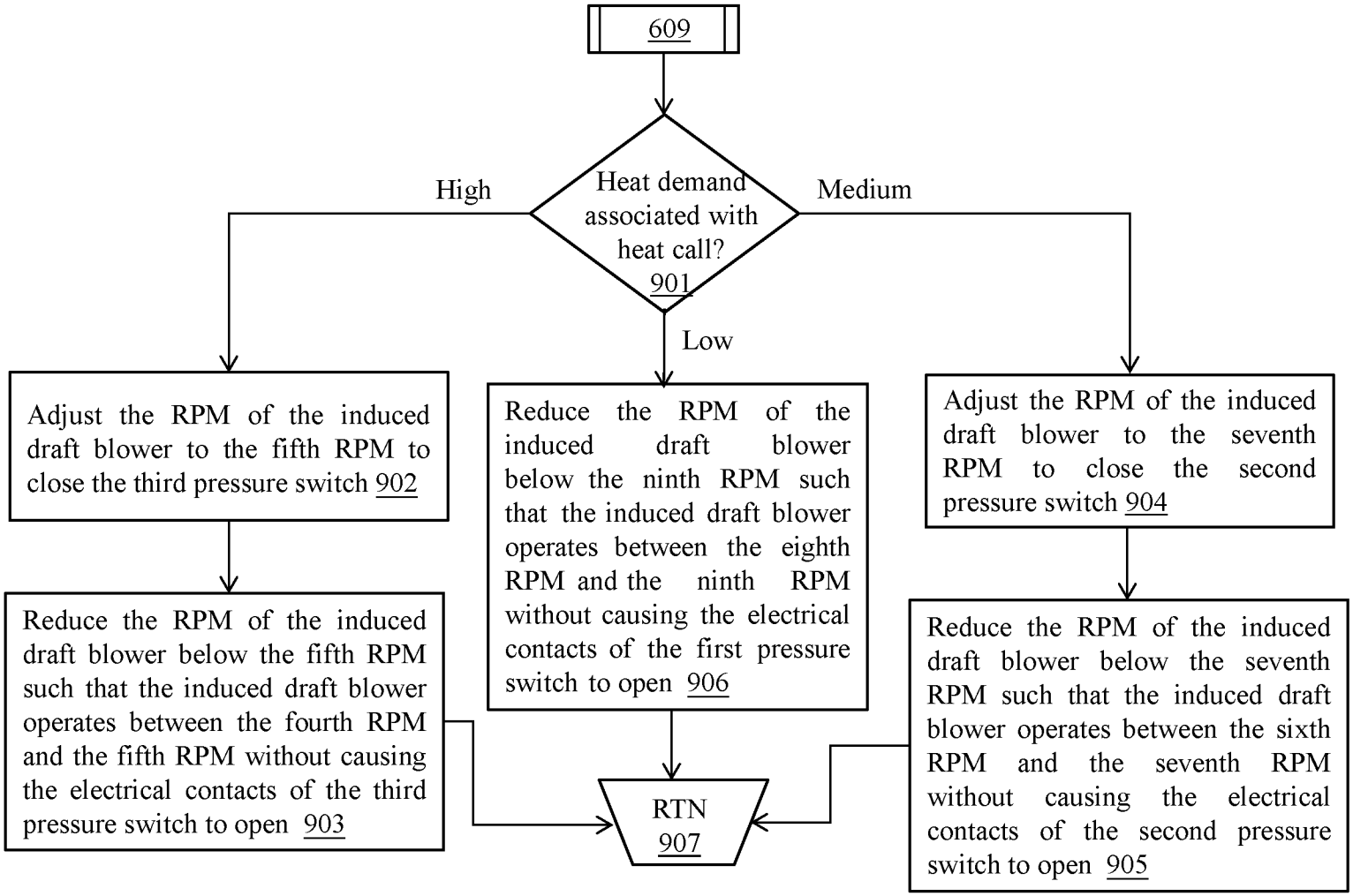
FIG. 9 is a flowchart that illustrates an example operation associated with a heating sequence associated with the calibration heat cycle of the gas furnace of FIG. 1, in accordance with example embodiments of the present disclosure.

Turning to FIG. 9, in operation 901, the furnace controller 102 determines whether the heat demand that is associated with the heat call received from the thermostat is a high heat demand, medium heat demand, or a low heat demand. Depending upon the heat demand, the furnace controller 102 will adjust the firing rate at which the gas furnace 100 operates. Further, the furnace controller 100 controls the induced draft blower RPM based on the heat demand. In particular, if the furnace controller 102 determines that the heat demand associated with the heat call is a low heat demand, then, the furnace controller 102 proceeds to operation 906 where the induced draft blower RPM is reduced to a RPM 395 below the warm calibration make point RPM 342 of the low-heat pressure switch 206, but above a warm calibration break point RPM 340 of the low-heat pressure switch 206 such that the low-heat pressure switch 206 remains closed. This is based on the assumption that the low-heat pressure switch is closed at the end of the calibration sequence before transitioning to the heating sequence.

After the pressure switch closes, the RPM of the induced draft blower 115 can be decreased slightly without opening the pressure switch because of the hysteresis property of the pressure switch. The slight difference (decrease) in RPM of combustion airflow improves the efficiency of the gas furnace 100. That is, the induced draft blower 115 is operated at the lowest possible RPM that is needed to keep the pressure switch closed, i.e., any RPM above the warm calibration break point RPM of the pressure switch. In some embodiments, the induced draft blower 115 may be operated at or above the warm calibration make point RPM of the pressure switch without departing from a broader scope of the present disclosure.

If the furnace controller 102 determines that the heat demand associated with the heat call is a medium heat demand, then, the furnace controller 102 proceeds to operation 904 where the induced draft blower RPM is increased to a warm calibration make point RPM 338 of the medium-heat pressure switch 204 to close the pressure switch contacts of the medium-heat pressure switch 204. Responsive to closing the pressure switch contacts of the medium-heat pressure switch 204, in operation 905, the furnace controller 102 reduces the RPM of the induced draft blower 115 to a RPM 393 below the warm calibration make point RPM 338 of the medium-heat pressure switch 204, but above a warm calibration break point RPM 336 of the medium-heat pressure switch 204 such that the medium-heat pressure switch 204 remains closed. However, in some example embodiments, the induced draft blower 115 may be operated at or above the warm calibration make point RPM 338 of the medium-heat pressure switch 204 without departing from a broader scope of the present disclosure.

Similarly, if the furnace controller 102 determines that the heat demand associated with the heat call is a high heat demand, in operations 902-903, the furnace controller 102 may operate the induced draft blower 115 at an RPM that is between the warm calibration break point RPM 332 and the warm calibration make point RPM 334 of the high-heat pressure switch 202 by: (a) first increasing the RPM of the induced draft blower 115 to the warm calibration make point RPM 334 of the high-heat pressure switch 202 to close the pressure switch contacts of the high-heat pressure switch 202, and then (b) reducing the induced draft blower 115 to an RPM 391 below the warm calibration make point RPM 334 of the high-heat pressure switch 202, but above a warm calibration break point RPM 332 of the high-heat pressure switch 202 such that the high-heat pressure switch 202 remains closed.

Once the induced draft blower RPMs have been adjusted to operate at the lower RPM possible to keep the a respective pressure switch closed based on the heat demand associated with the heat call, the furnace controller 102 returns to operation 610 of FIG. 6. Returning to FIG. 6, in operation 610, the furnace controller 102 determines whether a heat call has been satisfied and consequently the heat call has been removed as illustrated by reference number 345 of the FIG. 3. If the heat call has not been removed, then, the furnace controller 102 proceeds to operation 611 where the furnace controller 102 continues operating the induced draft blower 115 at the RPMs determined in operations 903, 905, and 906 of FIG. 9, e.g., between the warm calibration make point and break point RPMs of the respective pressure switch till the heat demand is met and the heat call is removed.

Even though the present disclosure describes that the furnace controller 102 operates the induced draft blower 115 at an RPM that is between the make and break point RPMs of each pressure switch, it is noted that in other example embodiments, the furnace controller 102 may operate the induced draft blower 115 at an RPM that is above the break point RPM of the pressure switches, but not necessarily between the make and break point RPMs of the pressure switches. However, to maximum efficiency, the furnace controller 102 preferably operates the induced draft blower 115 at an RPM that is between the make and break point RPMs of the pressure switches.

When the heat call is removed, in operation 612, the furnace controller 102 initiates and completes operations 347 associated with the end of the heat cycle. For example, as illustrated in FIG. 3, once the heat call is removed, in operation 612, the furnace controller 102 initiates a post-purge sequence 389 where the induced draft blower 115 is operated at a reduced RPM that is enough to remove the combustion gases of the current heat cycle from the heat exchanger tubes. Responsive to completing the post-purge sequence 389, the furnace controller 102 de-energizes the induced draft blower 115. Further, the furnace controller de-energizes the air circulation blower 119 after a predetermined delay period 387 provided to cool down the heat exchanger tubes of the gas furnace 100. Responsively, the furnace controller 102 ends the calibration heat cycle 300 and returns to operation 506 where the operation of the furnace controller 102 ends.

As described above, if a heat call is received from the thermostat after a calibration heat cycle 300 is completed, the furnace controller 102 executes a non-calibration heat cycle 400 unless a predetermined number of heat cycles has passed since the last calibration heat cycle 300. Further, one calibration heat cycle 300 may be followed by another calibration heat cycle 300 when the first calibration heat cycle 300 ends prematurely before the heat call is removed due to issues, such as, but not limited to, being unable to close the pressure switch contacts of one or more of the pressure switches 202-206 after repeated attempts to re-close the pressure switch contacts. However, if a calibration heat cycle 300 ends successfully, typically, the following heat cycle in response to a new heat call will be a non-calibration heat cycle 400.

Non-Calibration Heat Cycle

Figure 4:
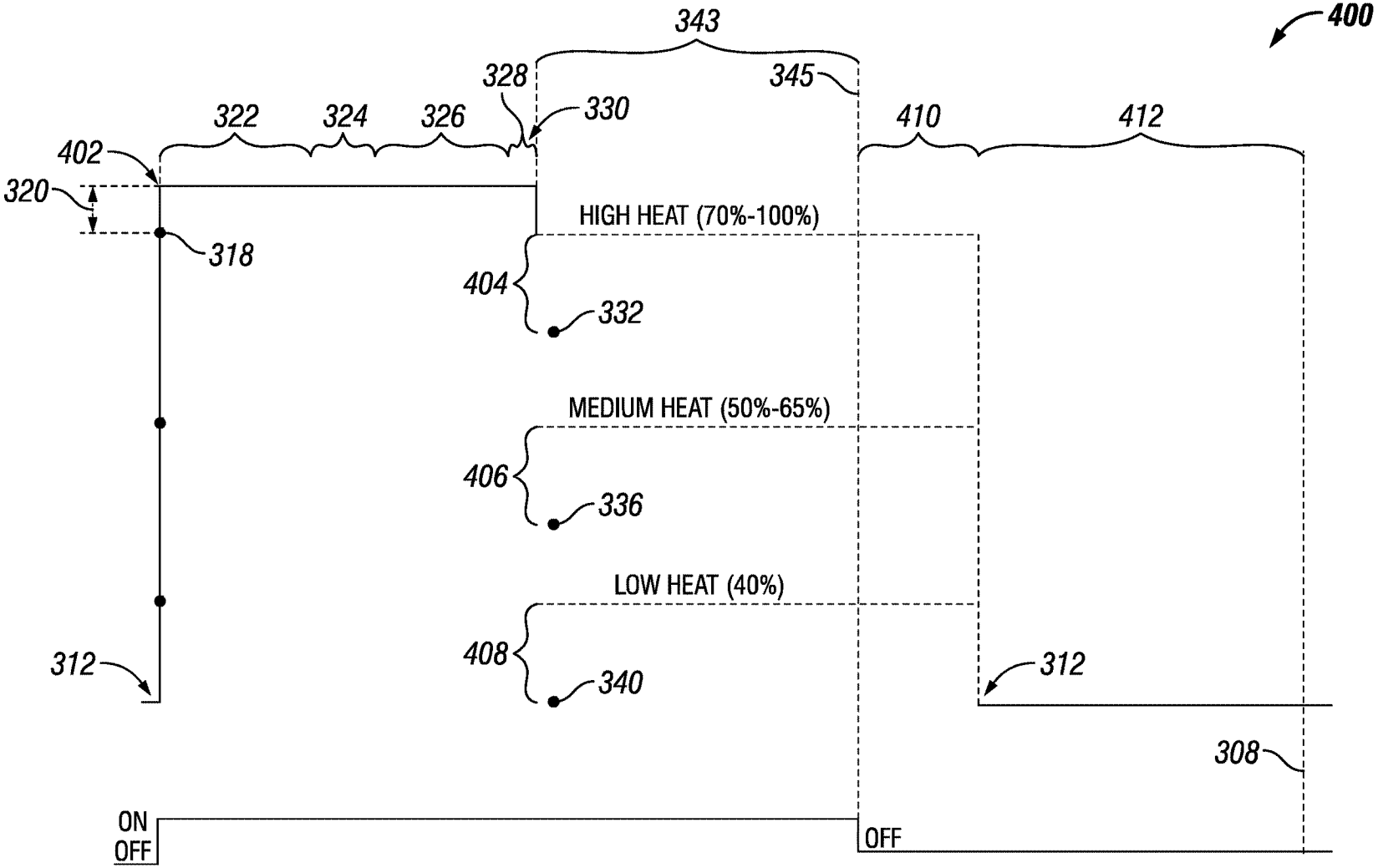
FIG. 4 is a line chart that illustrates a non-calibration heat cycle of the gas furnace of FIG. 1, in accordance with example embodiments of the present disclosure.

The non-calibration heat cycle 400 will be described below in greater detail in association with FIG. 10 by making reference to FIG. 4 as needed. As described above, the non-calibration heat cycle 400 is a heat cycle that does not include a calibration sequence 309. Instead, the non-calibration heat cycle 400 uses the recorded cold calibration make point RPMs (314, 316, and 318) and the warm calibration make and break point RPMs (332, 334, 336, 338, 340, and 342) from the last calibration heat cycle 300 to operate the induced draft blower 115 for satisfying a heat demand associated with the current heat call.

Figure 10A:
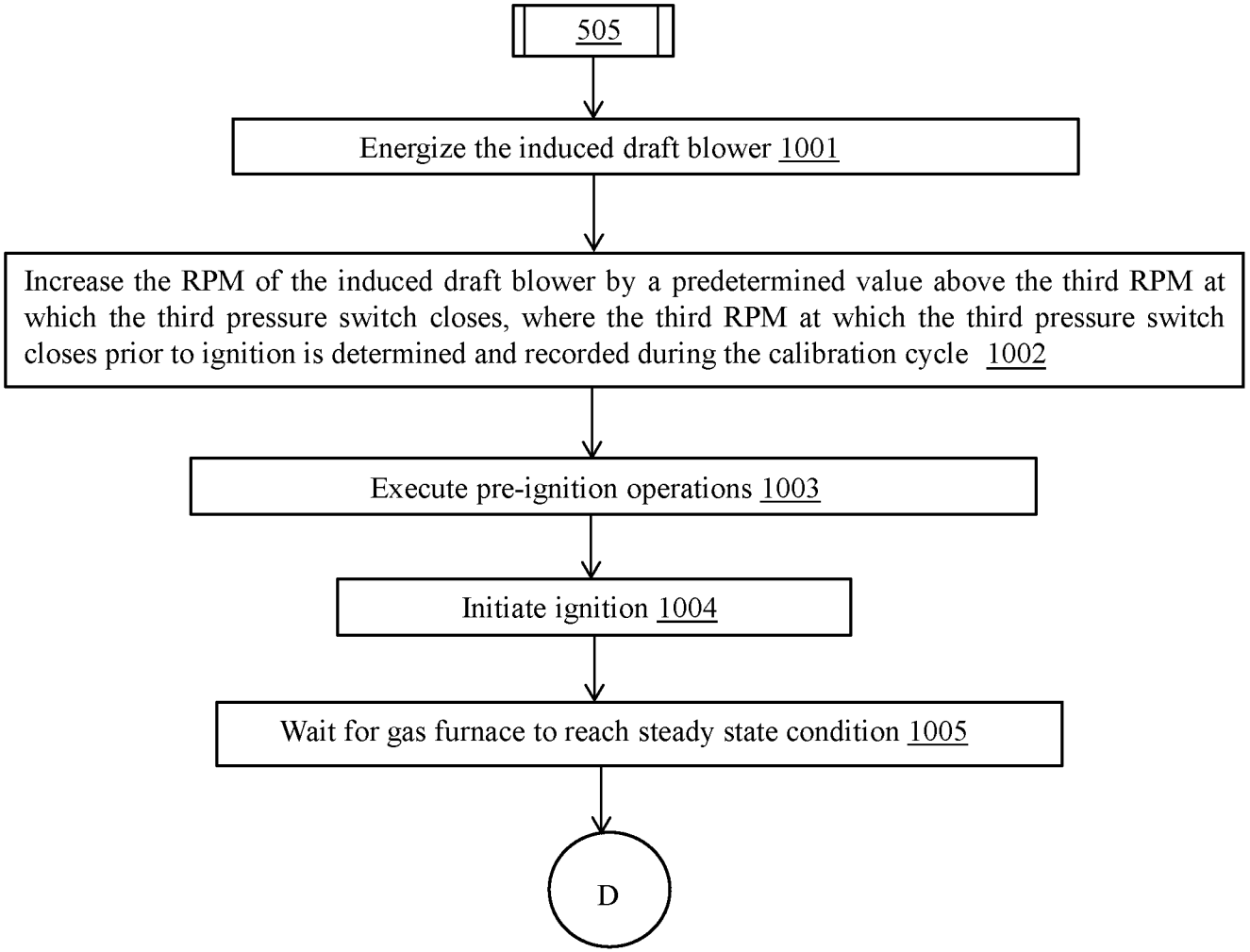
FIGS. 10A-10C (collectively 'FIG. 10') are flowcharts that illustrate an example operation associated with a non-calibration heat cycle of the gas furnace of FIG. 1, in accordance with example embodiments of the present disclosure.
Figure 10B:
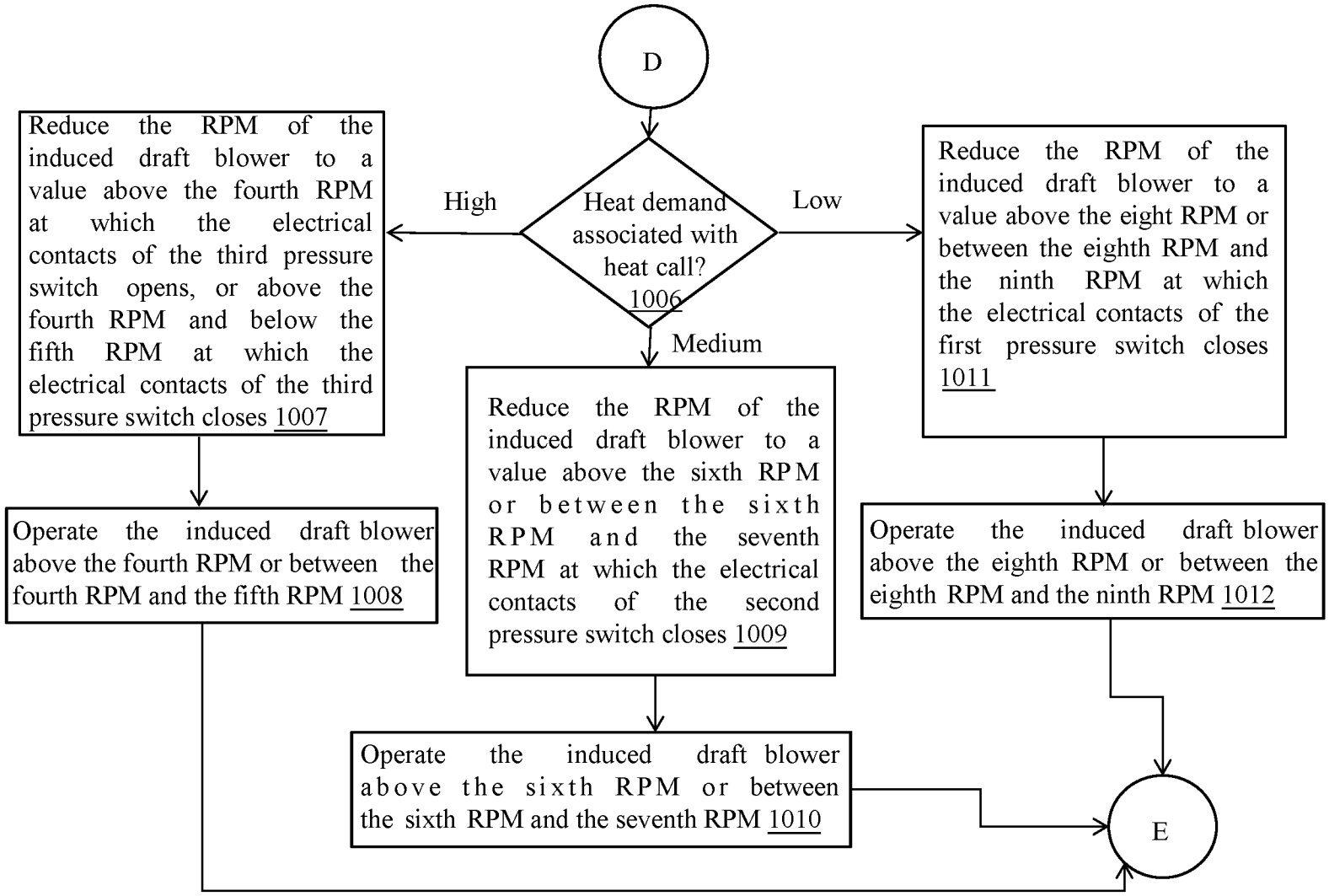
Figure 10C:
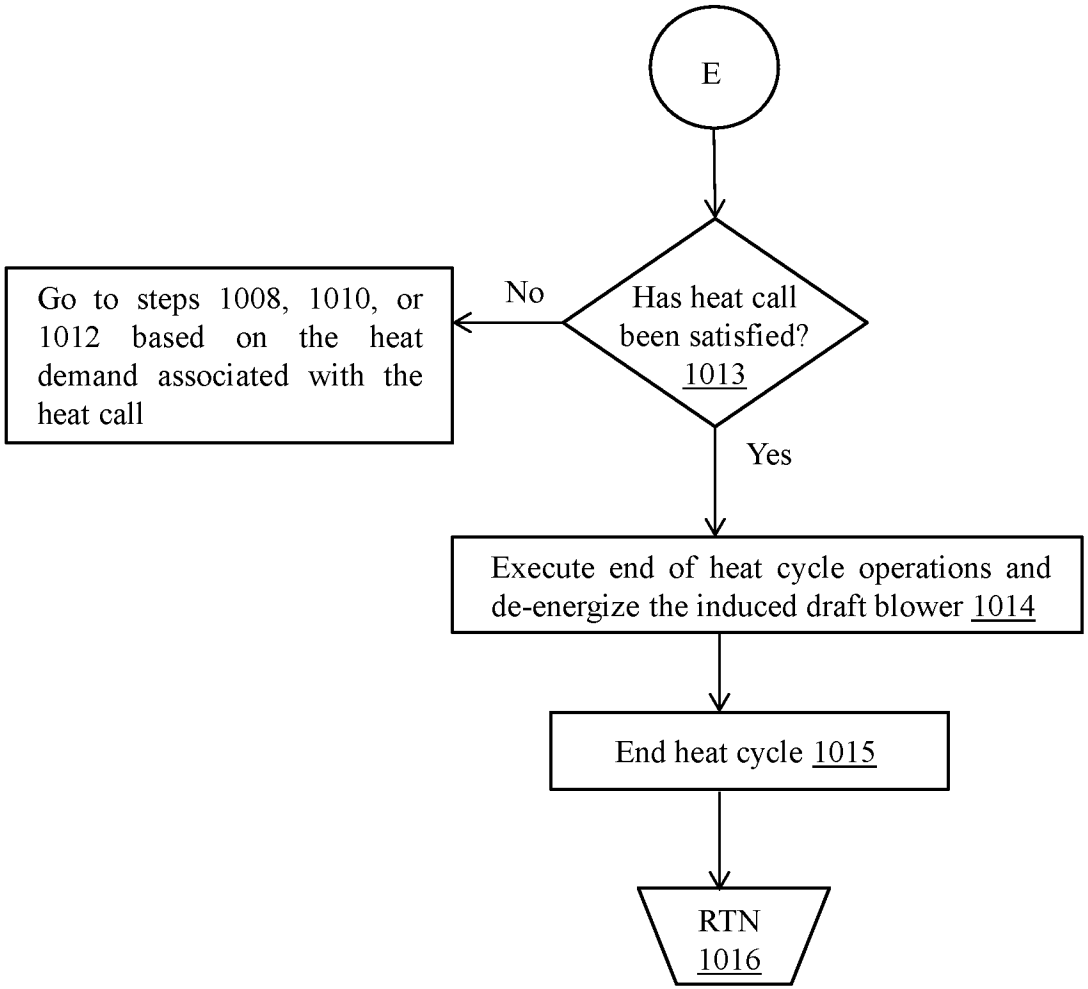
Figure 11A:
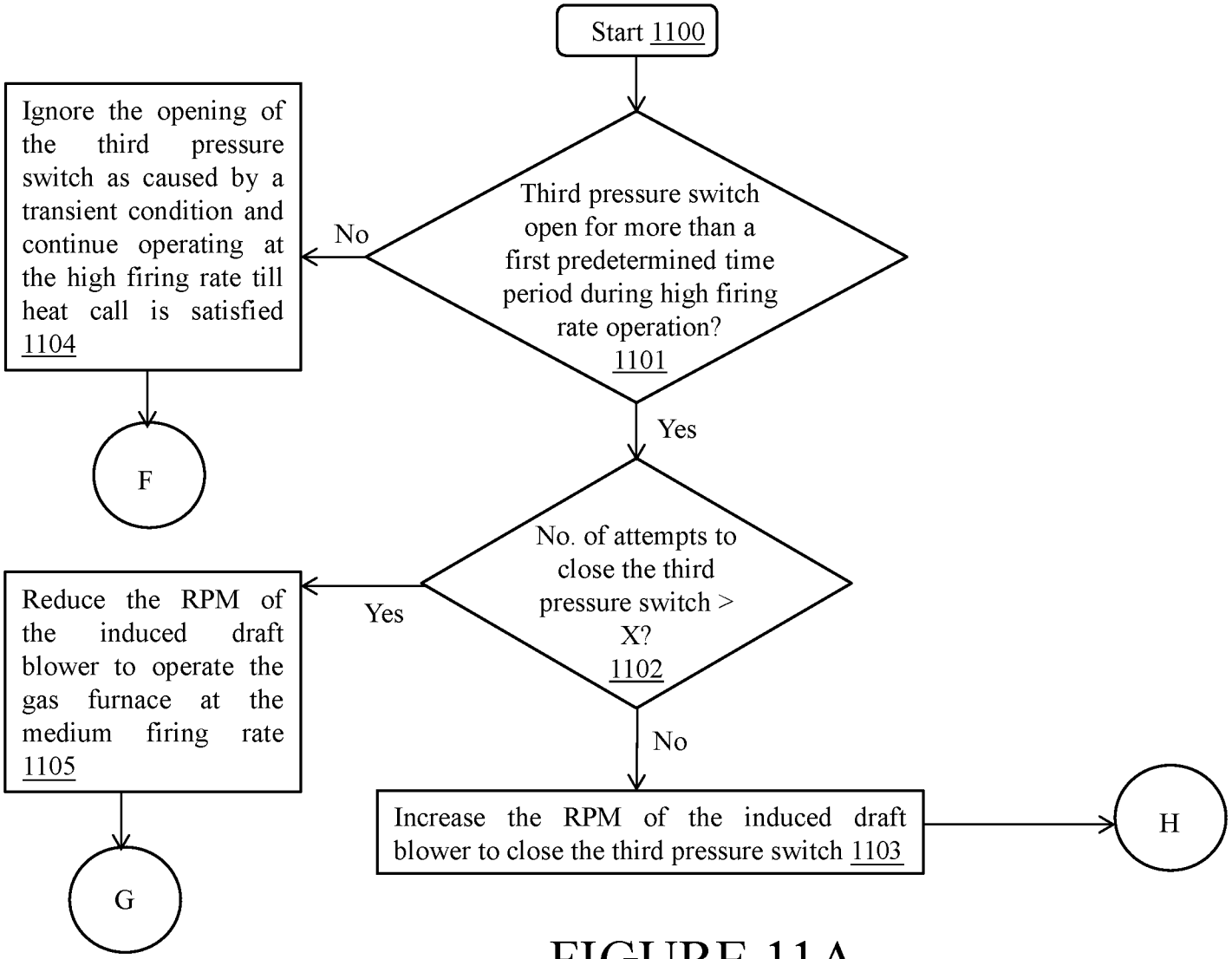
FIGS. 11A-11I (collectively 'FIG. 11') are flowcharts that illustrate an example operation associated with an example response of the gas furnace of FIG. 1 when one or more of the pressure switches of the gas furnace remain open for more than a predetermined time period, in accordance with example embodiments of the present disclosure.
Figure 11B:
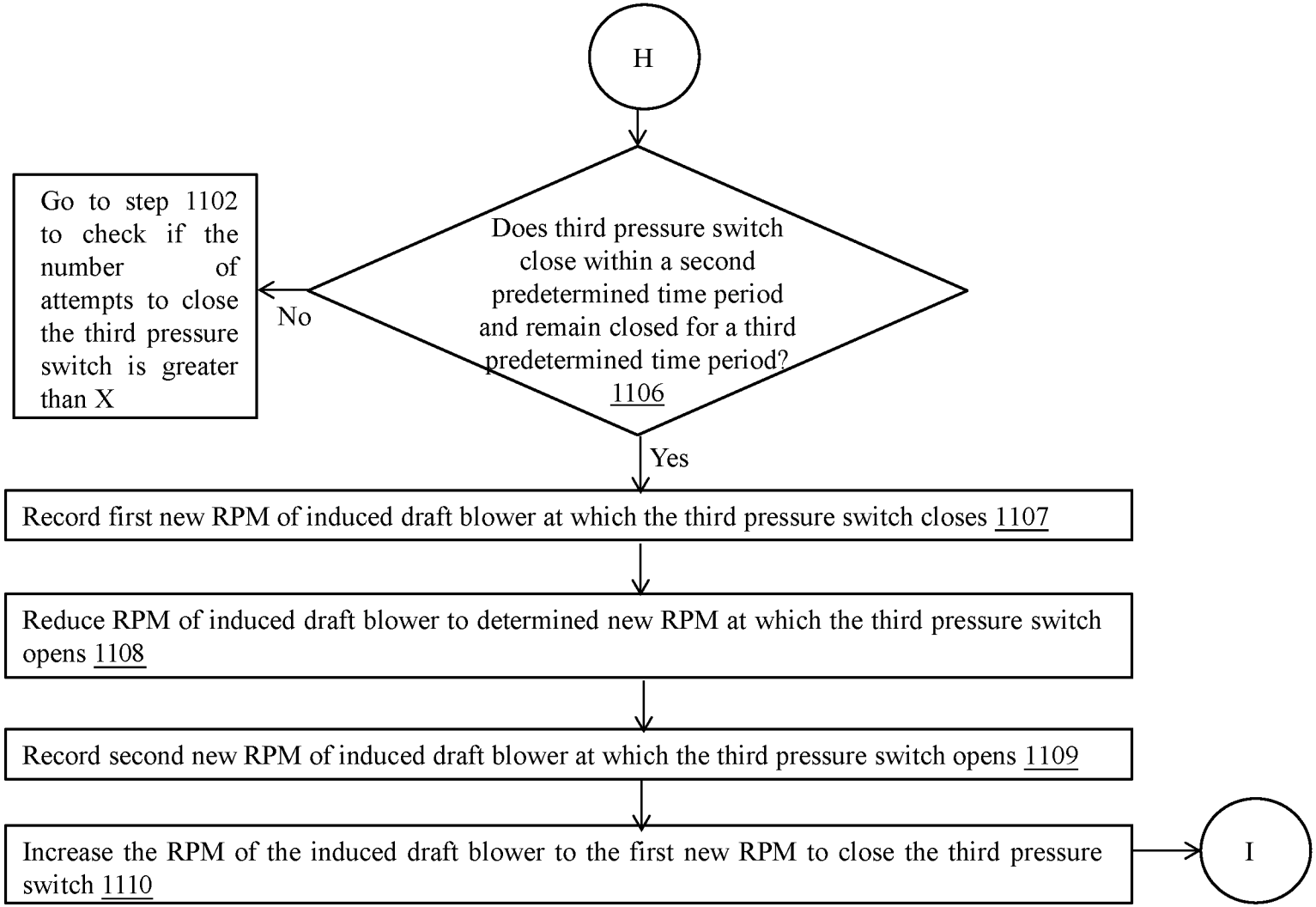
Figure 11C:
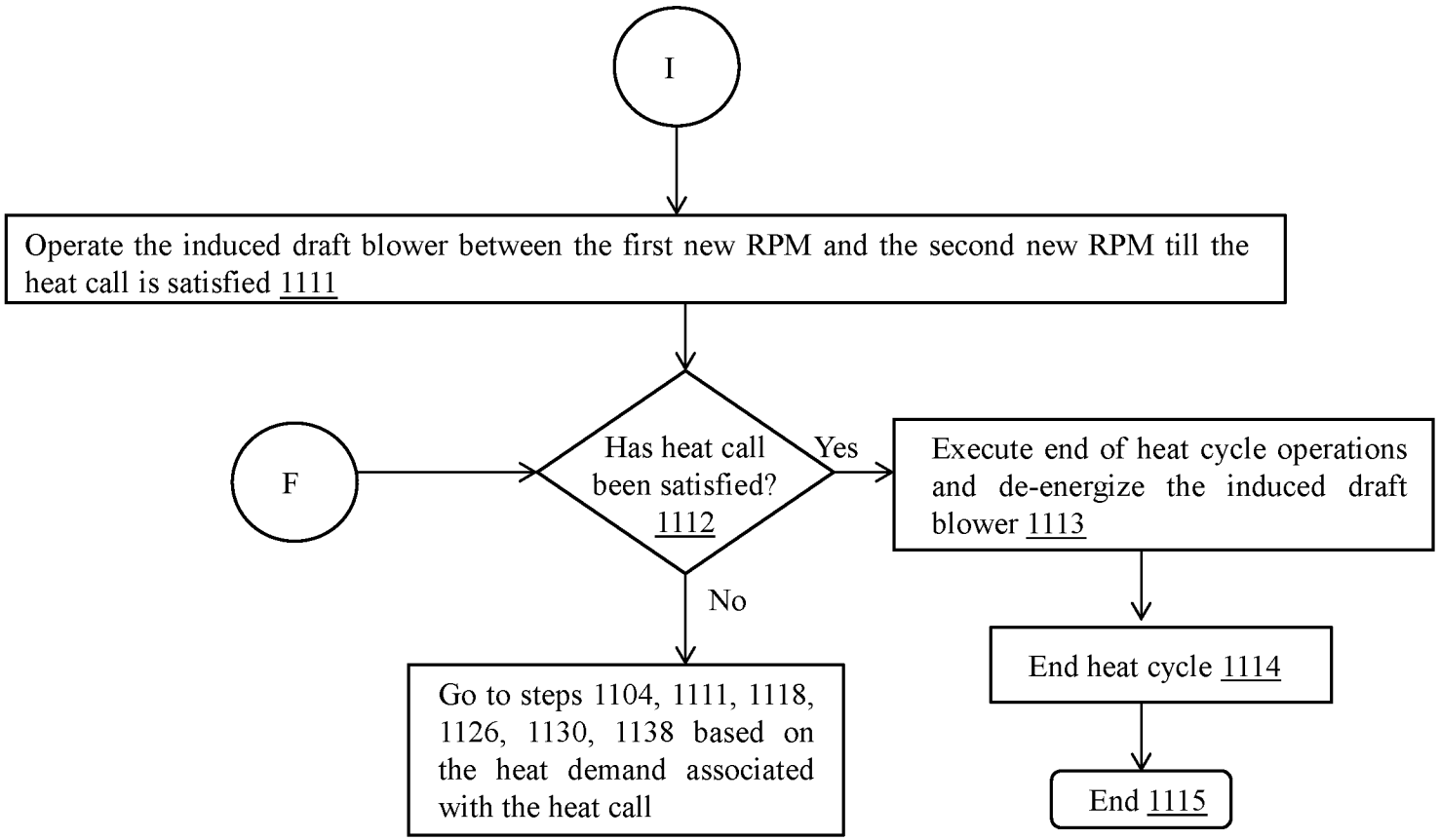
Figure 11D:
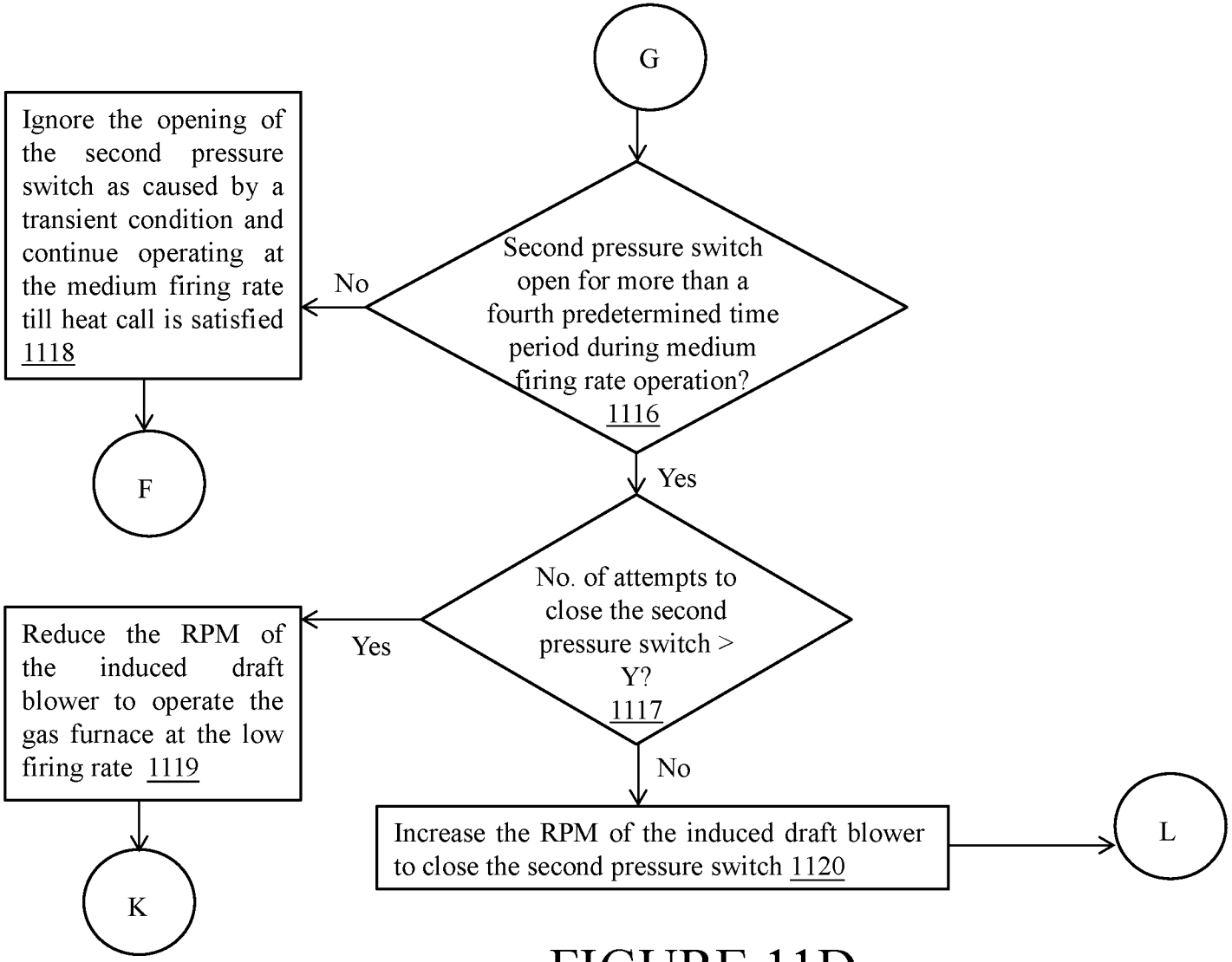
Figure 11E:
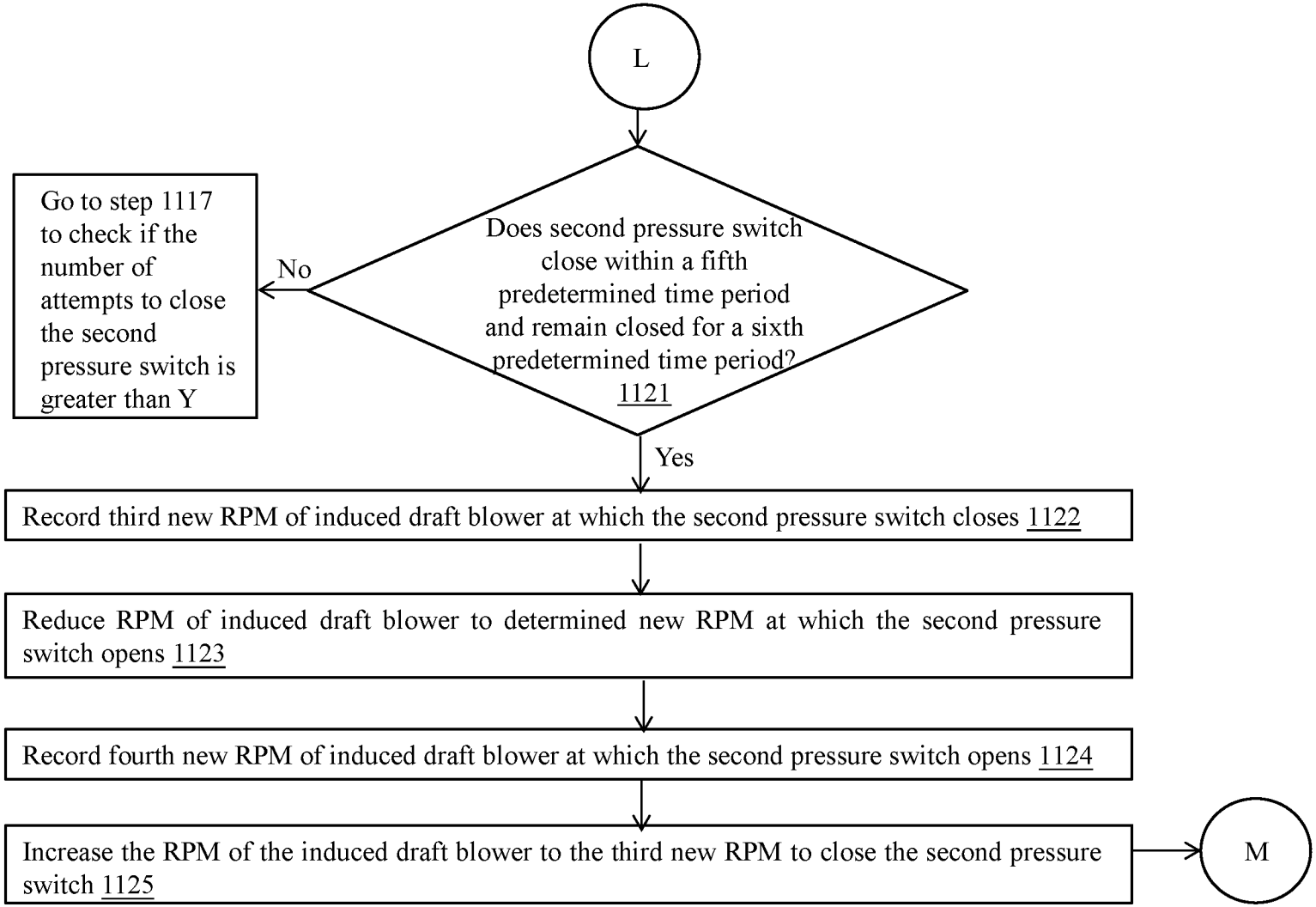
Figure 11F:
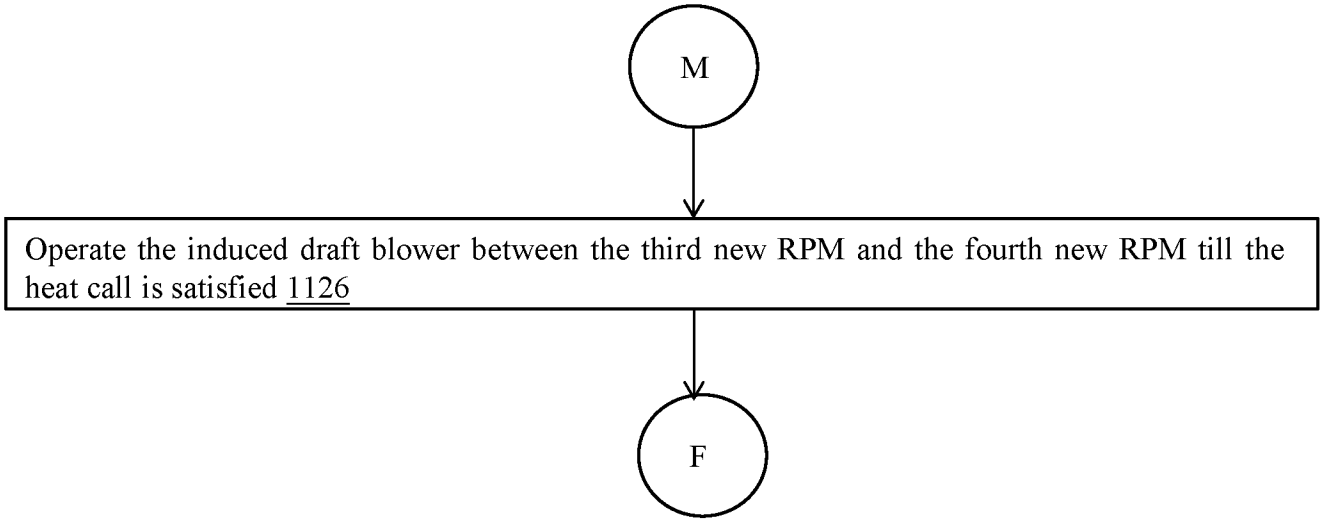
Figure 11G:
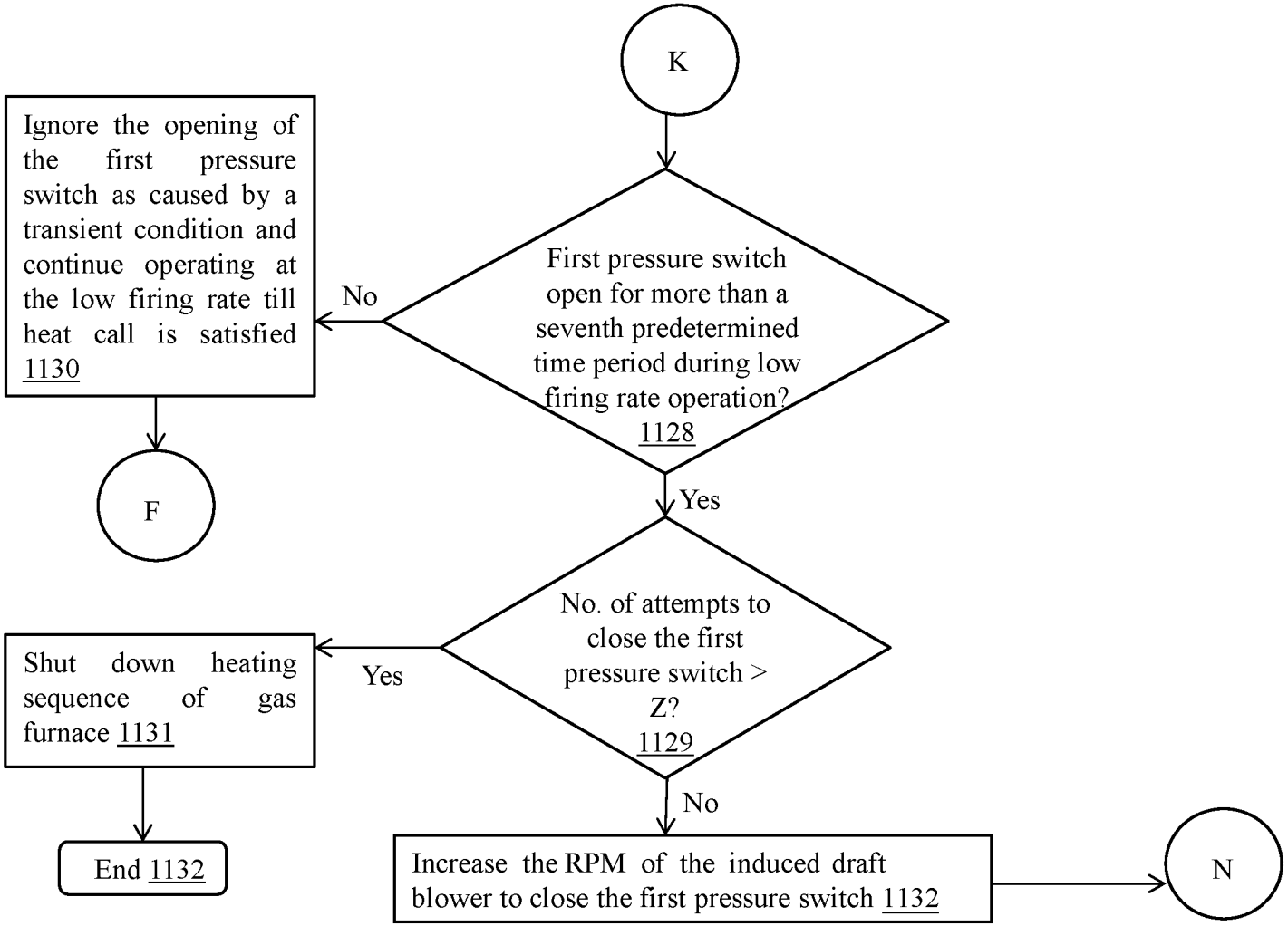
Figure 11H:
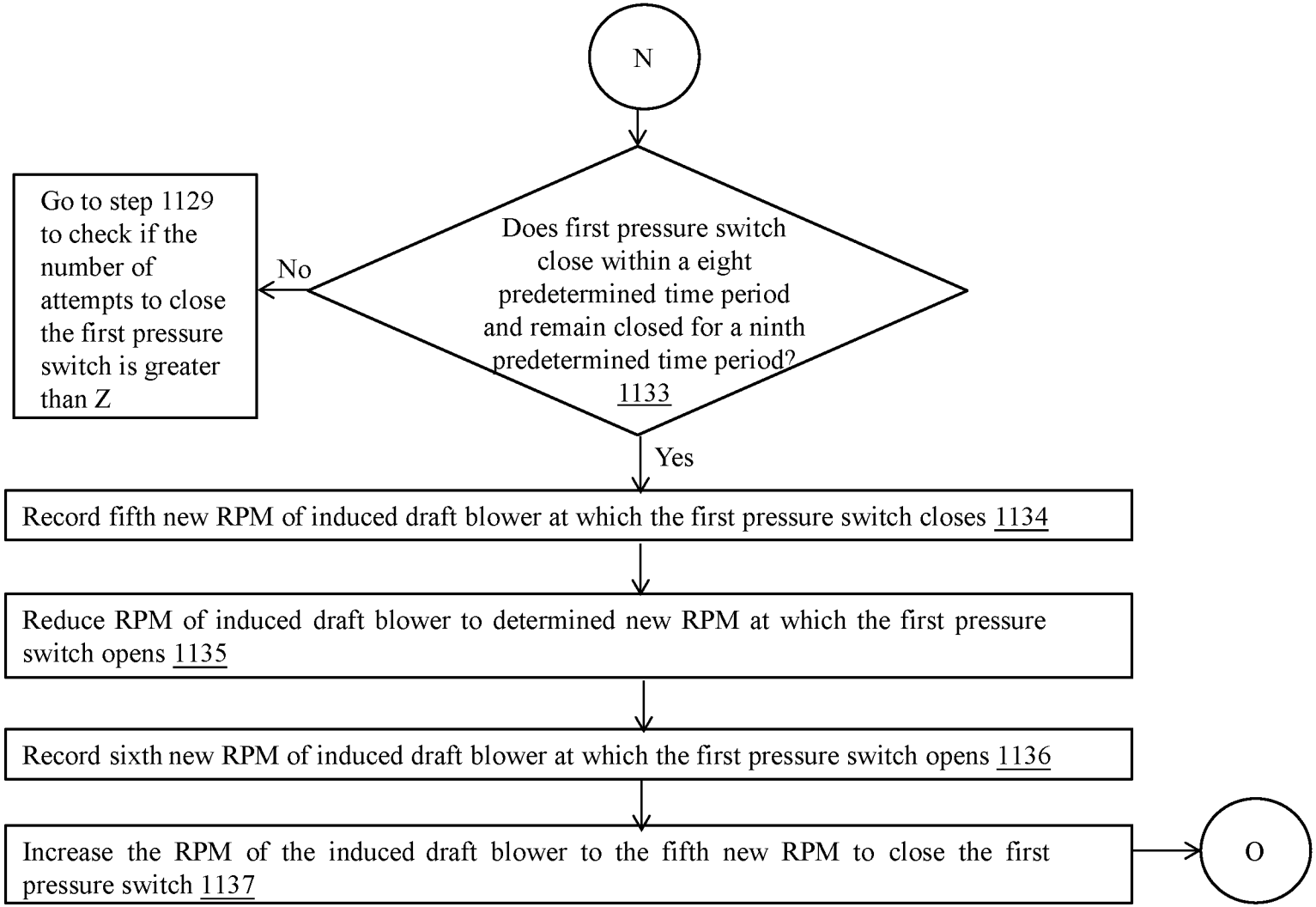
Figure 11I:
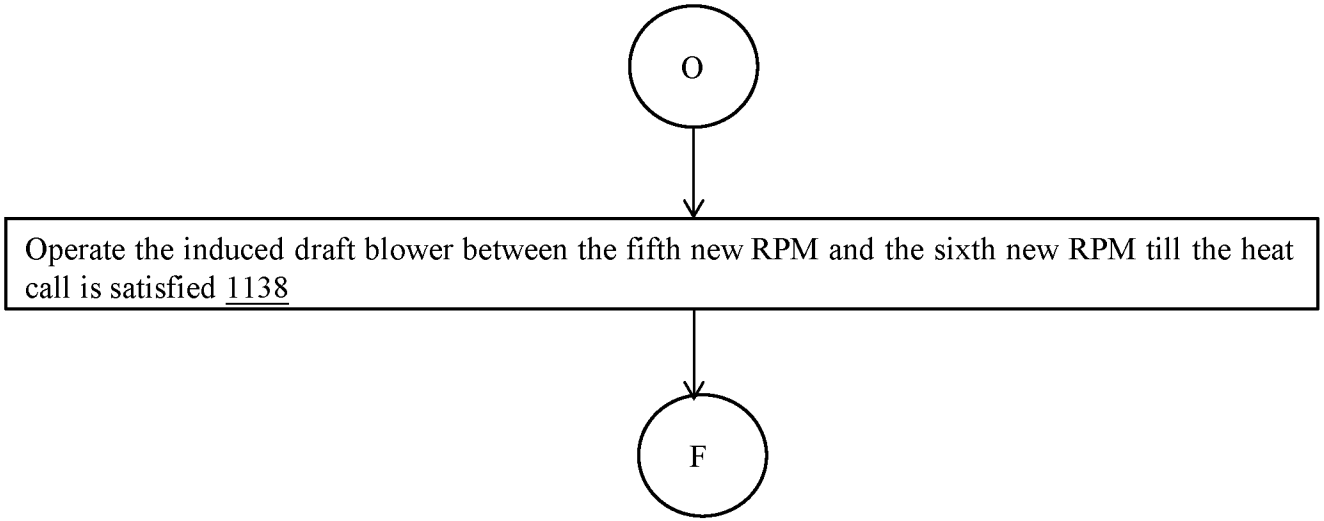

Turning to FIG. 10, in operation 1001, the furnace controller 102 begins the non-calibration heat cycle by turning on or energizing the induced draft blower 115. Then, in operation 1002, the furnace controller 102 retrieves the recorded ignition RPM 412 (buffer RPM 320+the cold calibration make point RPM 318 of the high-heat pressure switch 202) associated with the gas furnace 100 from a memory associated with the furnace controller 102. Further, in operation 1002, the RPM of the induced draft blower 115 is increased to the ignition RPM 412 to start ignition. Once the RPM of the induced draft blower 115 is increased to the ignition RPM 412, in operations 1003-1005, the furnace controller 102 executes the pre-ignition sequence 322, the ignition sequence 324, the post-ignition delay sequences 326-330 to get the gas furnace to a steady-state heating condition is reached. Operations 1003-1005 are substantially similar to operations 604-606 of the calibration heat cycle 300 which are described in association with FIG. 6. Therefore, operations 1003-1005 are not discussed in further detail herein for the sake of brevity.

Once the steady-state heating condition is reached, in operation 1006, the furnace controller 102 determines the firing rate at which the gas furnace 100 is to operate based on the heat demand associated with the heat call received from the thermostat that is disposed in the area to be heated. If the furnace controller 102 determines that the heat demand associated with the heat call is a high heat demand, the furnace controller 102 proceeds to operation 1007 where the RPM of the induced draft blower 115 is reduced from the ignition RPM 412 at which all the pressure switches 202-206 are closed to an operational RPM 391 that is above the warm calibration break point RPM 332 of the high-heat pressure switch 202, but below the warm calibration make point RPM 334 of the high-heat pressure switch 202 such that the high-heat pressure switch 202 remains closed. The operational RPM 391 is obtained by adding an incremental RPM 404 to the warm calibration make point RPM 334 of the high-heat pressure switch 202. Further, in operation 1008, the furnace controller 102 operates the induced draft blower 115 at the operational RPM 391 till the heat demand is satisfied and the heat call is removed.

Similarly, if the furnace controller 102 determines that the heat demand associated with the heat call is a medium heat demand or a low heat demand, the furnace controller 102 executes operations 1009-1010 or 1011-1012, respectively. In operations 1009-1010, the RPM of the induced draft blower 115 is reduced from the ignition RPM 412 to an operational RPM 393 that is above the warm calibration break point RPM 336 of the medium-heat pressure switch 204, but below the warm calibration make point RPM 338 of the medium-heat pressure switch 204 such that the medium-heat pressure switch 204 remains closed. In operations 1011-1012, the RPM of the induced draft blower 115 is reduced from the ignition RPM 412 to an operational RPM 395 that is above the warm calibration break point RPM 340 of the low-heat pressure switch 206, but below the warm calibration make point RPM 342 of the low-heat pressure switch 206 such that the low-heat pressure switch 206 remains closed.

In operation 1013, the furnace controller 102 determines whether the heat demand associated with the heat call has been satisfied and consequently the heat call has been removed. If the heat call has not been removed, the furnace controller continues to operate the induced draft blower 115 between the warm calibration make and break points of the respective pressure switches till the heat call is removed. If the heat call has been removed, in operations 1014-1015, the furnace controller 102 executes operations associated with the end of the heat cycle and de-energizes the induced draft blower 115. Further, the furnace controller 102 de-energizes the air circulation blower 119 and ends the non-calibration heat cycle. Operations 1014-1015 are substantially similar to operations 612-613 of the calibration heat cycle 300 described in association with FIG. 6. Therefore, operations 1003-1005 are not discussed in further detail herein for the sake of brevity. Responsive to ending the non-calibration heat cycle 400, the furnace controller 102 returns to operation 506 where the operation of the furnace controller 102 ends.

As described above in association with the calibration heat cycle, one of ordinary skill in the art can understand and appreciate that in some example embodiments, the induced draft blower 115 can be operated at or above the warm calibration make point RPMs of a pressure switch without departing from a broader scope of the present disclosure.

Turning to FIG. 11, this figure is a flowchart that illustrates an example response of the gas furnace 100 when one or more of the pressure switches of the gas furnace open. As described above, since the pressure switches 202-206 of the gas furnace 100 are not connected in series with the gas valve 106, the gas valve 106 is not de-energized and consequently the combustion cycle switched off when the pressure switch contacts of any one of the pressure switches 202-206 open. Instead, in the gas furnace 100 of the present disclosure, when the pressure switch contacts of the pressure switches 202-206 open for more than a predetermined time period, the furnace controller 102 either attempts to re-close the pressure switch contacts of the open pressure switch by increasing a RPM of the induced draft blower 115, or switches an operation of the gas furnace 100 to a different firing rate provided the pressure switch associated with the different firing rate is closed and is functioning without error. The gas valve is de-energized and the combustion cycle is shut down only when a threshold number of attempts to close one or more of the pressure switches 202-206 has been exhausted.

It is noted that the flowchart of FIG. 11 is based on the assumption that the gas furnace 100 is currently operating at a high firing rate. Referring to FIG. 11, in operation 1101, the furnace controller 102 determines whether the high-heat pressure switch 202 has opened and has remained open for more than a first threshold time period. If the furnace controller 102 determines that the pressure switch contacts of the high-heat pressure switch 202 have remained open for less than the first threshold time period, then, in operation 1104, the furnace controller 102: (a) ignores or filters out the event of the high-heat pressure switch 202 being opened for less than the first threshold time period as being caused by a transient condition, and (b) continues to operate the gas furnace without de-energizing the gas valve 106 and shutting down the combustion cycle.

However, if the furnace controller 102 determines that the pressure switch contacts of the high-heat pressure switch 202 have remained open for more than or equal to the first threshold time period, then, in operation 1102, the furnace controller 102 determines whether the number of attempts to reclose the high-heat pressure switch 202 has exceeded a threshold number of attempts X. If the number of attempts to reclose the high-heat pressure switch 202 has not exceeded the threshold number of attempts, then, in operation 1103, the furnace controller 102 increases the RPM of the induced draft blower 115 in an attempt to reclose the high heat pressure switch 202. Then, in operation 1106, the furnace controller 102 determines whether the high-heat pressure switch 202 closes within a second threshold time period and remains closed for a third threshold time period.

If the high-heat pressure switch 202 closes within the second threshold time period and remains closed for a third threshold time period responsive to the increase in RPM of the induced draft blower 115, then, in operation 1107, the furnace controller 102 records the RPM of the induced draft blower 115 at which the high-heat pressure switch closed (or RPM of the induced draft blower 115 at which the high-heat pressure switch closed plus a nominal RPM adder) as a new warm calibration make point of the high-heat pressure switch 202. Further, in operations 1108-1109, the furnace controller 102 reduces the RPM of the induced draft blower 115 to determine and record a new warm calibration break point RPM of the high-heat pressure switch 202. Once the new warm calibration make point and break point RPMs of the high-heat pressure switch 202 are determined, in operations 1110 and 1111, the furnace controller 102 controls the induced draft blower 115 to operate below the new warm calibration make point RPM and above the new warm calibration break point RPM till the heat call is satisfied, provided the high-heat pressure switch 202 does not open for more than the first threshold time period again. Responsive to determining that the heat demand has been satisfied and the heat call has been removed in operation 1112, the furnace controller 102 executes operations associated with the end of the heat cycle and de-energizes the induced draft blower 115. Further, in operation 1114, the furnace controller 102 ends the heat cycle and the process ends in operation 1115. If the furnace controller 102 determines that the heat demand has not been satisfied and the heat call has not been removed, then, the furnace controller 102 continues to operate the induced draft blower 115 in between the new warm calibration make point and break point RPMs of the respective pressure switch based on the firing rate of the gas furnace 100.

In another example embodiment, in operation 1102, if the number of attempts to reclose the high-heat pressure switch 202 has not exceeded the threshold number of attempts, then, the furnace controller 102 executes a different set of operations that vary from the operations 1103-1111 as described above in association with the example embodiment of FIG. 11. In the other example embodiment, when the high-heat pressure switch is open and the number of attempts to reclose the high-heat pressure switch 202 has not exceeded the threshold number of attempts, then, the furnace controller 102 increases the RPM of the induced draft blower 115 significantly to reclose the high-heat pressure switch. That is, because of the need to quickly reclose the high-heat pressure switch 202, the furnace controller 102 does not gradually increase the RPM of the induced draft blower 115 to identify the new make point when the high-heat pressure switch 202 is open. Instead, the furnace controller 102 significantly increases the RPM of the induced draft blower 115 in an attempt to quickly reclose the high-heat pressure switch 202. Once the high-heat pressure switch 202 has been reclosed, then, the furnace controller 102 operates to determine the new warm calibration make and break point RPMs. That is, once the high-heat pressure switch 202 has been reclosed, the furnace controller 102 gradually (slowly) reduces the RPM of the induced draft blower 115 to determine a new warm calibration break point RPM of the high-heat pressure switch 202. Responsive to determining the new warm calibration break point RPM of the high-heat pressure switch 202, the furnace controller 102 gradually increases the RPM of the induced draft blower to determine the new warm calibration make point RPM of high-heat pressure switch 202. Once the new warm calibration make and break point RPMs have been determined, the furnace controller 102 increases the RPM of the induced draft blower 115 above the new warm calibration make point to insure closing of the high-heat pressure switch 202 above any potential chattering point (rapid opening and closing). Then, the furnace controller 102 reduces the RPM of the induced draft blower 115 to be between the new warm calibration break point RPM and the new warm calibration make point RPM of the high-heat pressure switch 202. In some example embodiments, the RPM of the induced draft blower 115 may be maintained above the new warm calibration break point of the high-heat pressure switch 202 and not necessarily below the new warm calibration make point RPM. However, preferably the RPM of the induced draft blower 115 is maintained between the new warm calibration break point RPM and the new warm calibration make point RPM of the high-heat pressure switch 202 for the most efficient operation.

Even though the operations of the other example embodiment described above is associated with the high-heat pressure switch 202, one of skill in the art can understand and appreciate that the operations described above in the other example embodiment is equally applicable to the other pressure switches (204, 206) without departing from a broader scope of the present disclosure.

However, in operation 1106, if the furnace controller 102 determines that the high-heat pressure switch 202 does not close within the second threshold time period and remain closed for a third threshold time period responsive to the increase in RPM of the induced draft blower 115, then, the furnace controller returns to operation 1102 to determine whether the number of attempts to reclose the high-heat pressure switch 202 has exceeded the threshold number of attempts. If the furnace controller 102 determines that the number of attempts to reclose the high-heat pressure switch 202 has exceeded the threshold number of attempts, then in operation 1105, the furnace controller 102 switches the operation of the gas furnace 100 to a lower firing rate, e.g., a medium firing rate where the pressure switch associated with the lower firing rate is monitored.

Even though the present disclosure describes that the furnace controller switches the operation of the gas furnace 100 that is operating at a high firing rate to a medium firing rate when the number of attempts to reclose the pressure switch contacts of the high-heat pressure switch 202 exceeds the threshold number of attempts, one of ordinary skill in the art can understand and appreciate that in other example embodiments, when the number of attempts to reclose the pressure switch contacts of the high-heat pressure switch 202 exceeds the threshold number of attempts, the furnace controller 102 may de-energize the gas valve 106 and shut down the combustion cycle or switch the operation of the gas furnace 100 to a low firing rate instead of a medium firing rate without departing from a broader scope of the present disclosure.

The response of the furnace controller 102 to an open medium-heat pressure switch 204 and an open low-heat pressure switch 206 is substantially similar to that of the response of the furnace controller 102 to an open high-heat pressure switch 202 as discussed above in operations 1101-1115 except that: (a) when a number of attempts to reclose a medium-heat pressure switch 204 exceeds a threshold number of attempts, the furnace controller 102 further reduces the firing rate of the gas furnace to a low firing rate or switch-off the combustion cycle, and (b) when a number of attempts to reclose a low-heat pressure switch 204 exceeds a threshold number of attempts, the furnace controller 102 de-energizes the gas valve 106 and switches-off the combustion cycle. That is, operations 1116-1127 and operations 1128-1138 associated with the response of the furnace controller 102 when the medium-heat pressure switch 204 and the low-heat pressure switch 206 are open, respectively, are substantially similar to operations 1101-1111 associated with the response of the furnace controller 102 when the high-heat pressure switch 202 is open except for the differences discussed above. Accordingly, operations 1116-1127 and operations 1128-1138 are not described in greater detail herein for the sake of brevity.

The goal of the operation of the furnace controller 102 in response to an open pressure switch as described above in association with FIG. 11 is to complete a combustion cycle without prematurely ending it before the heat call is removed and to reduce or minimize a number of unnecessary resets of the combustion cycle. Accordingly, in FIG. 11, the furnace controller 102 de-energizes the gas valve 106 and shuts off the combustion cycle only when the threshold number of attempts to reclose the low-heat pressure switch 206 has exceeded the threshold number of attempts. The combustion cycle is shut-down once the low-heat pressure switch cannot be reclosed because operating the gas furnace with an induced draft blower RPM that is below the warm calibration break point of the low-heat pressure switch results in unsafe operating conditions where the level of carbon monoxide in the combustion gas produced may exceed a threshold safe level. This is because when the induced draft blower 115 is operated below the warm calibration break point RPM of the low-heat pressure switch 206, an insufficient amount of combustion air is drawn in to generate combustion gases having lower carbon monoxide levels.

The example response of the furnace controller 102 to an open pressure switch as described in FIG. 11 allows the combustion cycle to stay on at least at a low firing rate even when the heat demand is high and the high-heat and medium-heat pressure switches cannot be closed. That is, even though the gas furnace 100 does not meet the high heat demand, it at least maintains some heat at the low firing rate when the high-heat and medium-heat pressure switches are not functional. This can be beneficial in various scenarios, such as, if the furnace controller 102 is unable to close the high-heat pressure switches and the medium-heat pressure switches in a gas furnace at a vacation home during winter, the example response of FIG. 11 would at least keep the gas furnace operating at the low firing rate which would keep the pipes from freezing by providing a basic heat level.

Even though FIG. 11 describes that the firing rate of the gas furnace is reduced to a low firing rate when the number of attempts to reclose the medium heat pressure switch exceeds the threshold amount of attempts, one of ordinary skill in the art can understand and appreciate that in some example embodiments, the firing rate of the gas furnace may be increased to a high firing rate when the number of attempts to reclose the medium heat pressure switch exceeds the threshold amount of attempts and the high-heat pressure switch is functioning properly. Further, it is noted that the number of attempts to reclose the pressure switches may be the same or may vary for the low-heat pressure switch 206, the medium-heat pressure switch 204, and the high-heat pressure switch 202. Furthermore, the threshold time periods for which the pressure switches can remain open before the furnace controller takes steps to reclose the pressure switches may be the same or may vary for the low-heat pressure switch 206, the medium-heat pressure switch 204, and the high-heat pressure switch 202.

Figure 12:
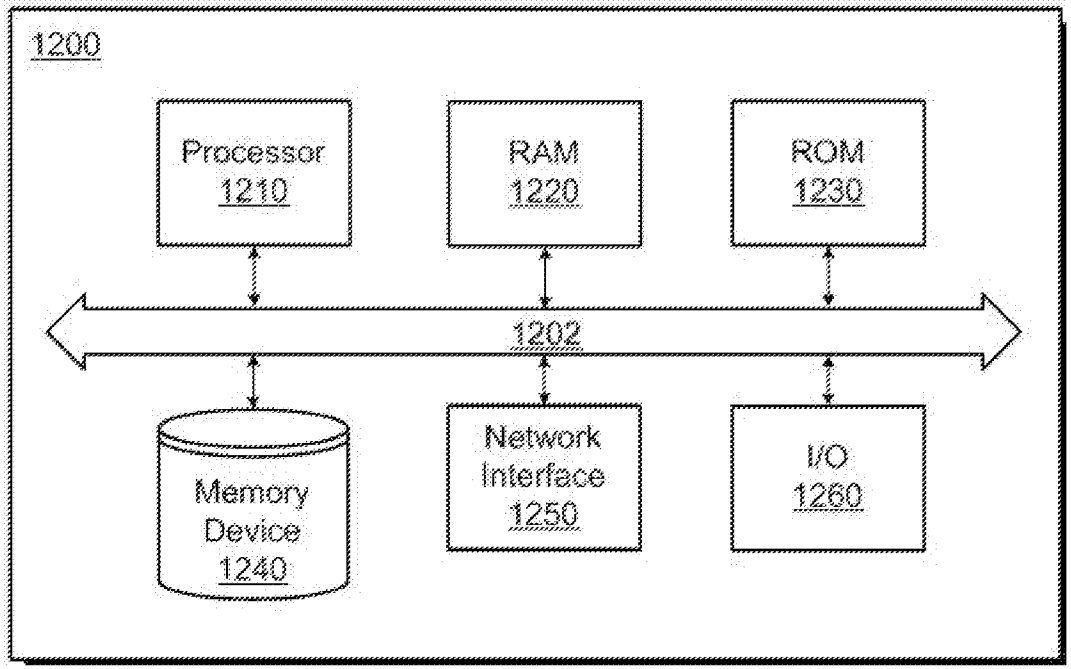
FIG. 12 illustrates a block diagram of an example controller, in accordance with example embodiments of the present disclosure.

Turning to FIG. 12, this figure illustrates an example hardware diagram of an example controller 1200. The furnace controller 102 may be implemented using combinations of one or more of the elements of the example controller 1200. The controller 1200 includes a processor 1210, a Random Access Memory (RAM) 1220, a Read Only Memory (ROM) 1230, a memory (i.e., storage) device 1240, a network interface 1250, and an Input Output (I/O) interface 1260. The elements of the computer 1200 are communicatively coupled via a bus 1202.

The processor 1210 comprises any well-known general purpose arithmetic processor. Both the RAM 1220 and the ROM 1230 comprise well known random access and read only memory devices, respectively, that store computer-readable instructions to be executed by the processor 1210. The memory device 1240 stores computer-readable instructions thereon that, when executed by the processor 1210, direct the processor 1210 to execute various aspects of the present invention described herein. As a non-limiting example group, the memory device 1240 may comprise one or more of an optical disc, a magnetic disc, a semiconductor memory (i.e., a flash based memory), a magnetic tape memory, a removable memory, combinations thereof, or any other well-known memory means for storing computer-readable instructions. The I/O interface 1260 comprises input and output ports, device input and output interfaces such as a keyboard, pointing device, display, communication, and other interfaces. The bus 1202 electrically and communicatively couples the processor 1210, the RAM 1220, the ROM 1230, the memory device 1240, the network interface 1250, and the I/O interface 1260, so that data and instructions may be communicated among the processor 1210, the RAM 1220, the ROM 1230, the memory device 1240, the network interface 1250, and the I/O interface 1260. In operation, the processor 1210 is configured to retrieve computer-readable instructions stored on the memory device 1240, the ROM 1230, or another storage means, and copy the computer-readable instructions to the RAM 1220 for execution. The processor 1210 is further configured to execute the computer-readable instructions to implement various aspects and features of the present invention described herein.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A gas furnace comprising:

a furnace controller;

an induced draft blower that is coupled to the furnace controller, the induced draft blower comprising an inducer motor that is controlled by the furnace controller and an inducer fan that is coupled to the inducer motor;

a pressure switch assembly that is coupled to the furnace controller, the pressure switch assembly comprising at least one pressure switch associated with a firing rate of the gas furnace, wherein an input contact of the at least one pressure switch is connected to an output port of the furnace controller that supplies power to the at least one pressure switch, and wherein an output contact of the at least one pressure switch is connected to an input port of the furnace controller;

a gas valve that is connected to an electrical relay; and a backup electrical relay that is connected in series with the electrical relay, wherein an input terminal of the backup electrical relay is connected to the output port of the furnace controller, wherein upon receiving a heat call, the furnace controller is configured to operate the induced draft blower at or close to a lowest speed that is needed to keep electrical contacts of the at least one pressure switch closed, wherein the lowest speed that is needed to keep electrical contacts of the at least one pressure switch closed is below a make point speed of the induced draft blower at which the electrical contacts of the at least one pressure switch close at a steady-state heating condition of the gas furnace, but above a break point speed of the induced draft blower at which the electrical contacts of the at least one pressure switch open at the steady-state heating condition of the gas furnace, wherein when the electrical contacts of the at least one pressure switch remain open for more than a predetermined time period, the furnace controller is configured to increase a speed of the induced draft blower to a new speed to close the electrical contacts of the at least one pressure switch without shutting down the combustion heat cycle, and wherein when a number of attempts to close the electrical contacts of the at least one pressure switch by increasing the speed of the induced draft blower is equal to or greater than a threshold number of attempts, the furnace controller is configured to de-energize the gas valve and shut off the combustion heat cycle by controlling the backup electrical relay and the electrical relay.

2. The gas furnace of claim 1, wherein the furnace controller is configured to learn and record the make point speed and the break point speed of the induced draft blower at which the electrical contacts of the at least one pressure switch close and open, respectively, during a combustion heat cycle while a fuel-air mixture is being burned and the air circulating blower is energized in the steady-state heating condition of the gas furnace.

3. The gas furnace of claim 1, wherein the furnace controller is configured to learn and record another make point speed of the induced draft blower at which the electrical contacts of the at least one pressure switch close during the combustion heat cycle prior to an ignition sequence of the combustion heat cycle.

4. The gas furnace of claim 1, wherein the at least one pressure switch comprises:

a low-heat pressure switch that is associated with an operation of the gas furnace at a first firing rate;

a medium-heat pressure switch that is associated with an operation of the gas furnace at a second firing rate; and a high-heat pressure switch that is associated with an operation of the gas furnace at a third firing rate, and wherein the first firing rate is a low firing rate, the second firing rate is a medium firing rate, and the third firing rate is a high firing rate.

5. The gas furnace of claim 1, wherein when the number of attempts to close the electrical contacts of the at least one pressure switch by increasing the speed of the induced draft blower while operating at one firing rate is equal to or greater than a threshold number of attempts, the furnace controller is configured to switch the operation of the gas furnace to a different firing rate.

6. The gas furnace of claim 4, wherein:

when the electrical contacts of the high-heat pressure switch remain open for more than a predetermined time period, the furnace controller is configured to increase a speed of the induced draft blower to close the electrical contacts of the high-heat pressure switch without shutting down the combustion heat cycle, and when the number of attempts to close the electrical contacts of the high-heat pressure switch by increasing the speed of the induced draft blower is equal to or greater than a threshold number of attempts, the furnace controller is configured to switch the operation of the gas furnace to the medium firing rate or the low firing rate.

7. A gas furnace comprising:

a furnace controller;

an induced draft blower that is coupled to the furnace controller, the induced draft blower comprising an inducer motor that is controlled by the furnace controller and an inducer fan that is coupled to the inducer motor;

a pressure switch assembly that is coupled to the furnace controller, the pressure switch assembly comprising at least one pressure switch associated with a firing rate of the gas furnace, wherein an input contact of the at least one pressure switch is connected to an output port of the furnace controller that supplies power to the at least one pressure switch, and wherein an output contact of the at least one pressure switch is connected to an input port of the furnace controller; and a gas valve that is connected to an electrical relay; and a backup electrical relay that is connected in series with the electrical relay, wherein an input terminal of the backup electrical relay is connected to the output port of the furnace controller, wherein upon receiving a heat call, the furnace controller is configured to operate the induced draft blower at or close to a lowest speed that is needed to keep electrical contacts of the at least one pressure switch closed, wherein the lowest speed that is needed to keep electrical contacts of the at least one pressure switch closed is below a make point speed of the induced draft blower at which the electrical contacts of the at least one pressure switch close at a steady-state heating condition of the gas furnace, but above a break point speed of the induced draft blower at which the electrical contacts of the at least one pressure switch open at the steady-state heating condition of the gas furnace, wherein when the electrical contacts of the at least one pressure switch remain open for more than a predetermined time period, the furnace controller is configured to increase a speed of the induced draft blower to a new speed to close the electrical contacts of the at least one pressure switch without shutting down the combustion heat cycle, and wherein if the electrical contacts of the at least one pressure switch close and remain closed for another predetermined time period when the speed of the induced draft blower is increased to the new speed, the furnace controller is configured to: record the new speed as a new make point speed of the induced draft blower at which the electrical contacts of the at least one pressure switch close, and reduce the speed of the induced draft blower from the new make point speed to determine a new break point speed at which the electrical contacts of the at least one pressure switch open.

8. The gas furnace of claim 7, wherein the furnace controller is configured to:

increase the speed of the induced draft blower to the new make point speed to close the electrical contacts of the at least one pressure switch, and reduce the speed of the induced draft blower below the new make point speed such that: (a) the induced draft blower operates between the new make point speed and the new break point speed, and (b) the electrical contacts of the at least one pressure switch remain closed.

9. A system comprising:

a gas furnace that comprises:

an induced draft blower that is coupled to a furnace controller; and a pressure switch assembly that is coupled to the furnace controller, the pressure switch assembly comprising at least one pressure switch associated with a firing rate of the gas furnace, wherein an input contact of the at least one pressure switch is connected to an output port of the furnace controller that supplies power to the at least one pressure switch, and wherein an output contact of the at least one pressure switch is connected to an input port of the furnace controller; and wherein the furnace controller is configured to:

receive a first heat call;

learn and record at the furnace controller:

a make point speed at which electrical contacts of the at least one pressure switch close during a combustion heat cycle when the gas furnace is operating at a steady-state heating condition, a break point speed at which electrical contacts of the at least one pressure switch open during the combustion heat cycle when the gas furnace is operating at the steady-state heating condition, and another make point speed at which the electrical contacts of the at least one pressure switch close during the combustion heat cycle prior to an ignition sequence of a combustion heat cycle;

responsive to recording the make point speed, the break point speed, and the other make point speed, increase a speed of the induced draft blower to a make point speed to close the electrical contacts of the at least one pressure switch, and reduce the speed of the induced draft blower below the make point speed such that: (a) the induced draft blower operates between the make point speed and the break point speed, and (b) the electrical contacts of the at least one pressure switch remain closed receive a second heat call;

increase the speed of the induced draft blower above the other make point by a predetermined value to start an ignition sequence; and responsive to reaching a steady-state heating condition after the ignition sequence, reduce the speed of the induced draft blower to operate between the make point speed and the break point speed to satisfy a heat demand associated with the second heat call.

10. The system of claim 9, wherein the gas furnace further comprises:

a gas valve that is connected to an electrical relay; and a backup electrical relay that is connected in series with the electrical relay, wherein an input terminal of the backup electrical relay is connected to the output port of the furnace controller.

11. The system of claim 9, wherein the at least one pressure switch comprises:

a low-heat pressure switch that is associated with an operation of the gas furnace at a first firing rate;

a medium-heat pressure switch that is associated with an operation of the gas furnace at a second firing rate; and a high-heat pressure switch that is associated with an operation of the gas furnace at a third firing rate, and wherein the first firing rate is a low firing rate, the second firing rate is a medium firing rate, and the third firing rate is a high firing rate.

12. The system of claim 9, wherein when the electrical contacts of the at least one pressure switch remain open for more than a predetermined time period, the furnace controller is configured to increase a speed of the induced draft blower to a new speed to close the electrical contacts of the at least one pressure switch without shutting down the combustion heat cycle.

13. The system of claim 12, wherein when a number of attempts to close the electrical contacts of the at least one pressure switch by increasing the speed of the induced draft blower is equal to or greater than a threshold number of attempts, the furnace controller is configured to de-energize the gas valve and shut off the combustion heat cycle by controlling the backup electrical relay and the electrical relay.

14. The system of claim 12, wherein when a number of attempts to close the electrical contacts of the at least one pressure switch by increasing the speed of the induced draft blower while operating at one firing rate is equal to or greater than a threshold number of attempts, the furnace controller is configured to switch the operation of the gas furnace to a different firing rate.

15. The gas furnace of claim 12, wherein if the electrical contacts of the at least one pressure switch close and remain closed for another predetermined time period when the speed of the induced draft blower is increased to the new speed, the furnace controller is configured to:

record the new speed as a new make point speed of the induced draft blower at which the electrical contacts of the at least one pressure switch close, and reduce the speed of the induced draft blower from the new make point speed to determine a new break point speed at which the electrical contacts of the at least one pressure switch open.

16. A method of manufacturing a high efficiency gas furnace comprising a furnace controller, an induced draft blower, and at least one pressure switch, the method comprising:

connecting the induced draft blower to a furnace controller;

connecting an input contact of the at least one pressure switch to an output port of the furnace controller that supplies power to the at least one pressure switch;

connecting an output contact of the at least one pressure switch to an input port of the furnace controller;

connecting the output terminal of an electrical relay to a gas valve;

connecting the input terminal of the electrical relay to the output terminal of a backup electrical relay such that the electrical relay is in a series electrical circuit with the backup electrical relay; and connecting the input terminal of the backup electrical relay to the output port of the furnace controller, wherein the furnace controller is configured to operate the induced draft blower at or close to a lowest speed that is needed to keep electrical contacts of the at least one pressure switch closed in response to receiving a heat call, wherein the lowest speed that is needed to keep the electrical contacts of the at least one pressure switch closed is below a make point speed of the induced draft blower at which the electrical contacts of the at least one pressure switch close when the gas furnace is operating at a steady-state heating condition, but above a break point speed of the induced draft blower at which the electrical contacts of the at least one pressure switch open when the gas furnace is operating at a steady-state heating condition, wherein when the electrical contacts of the at least one pressure switch remain open for more than a predetermined time period, the furnace controller is configured to increase a speed of the induced draft blower to a new speed to close the electrical contacts of the at least one pressure switch without shutting down the combustion heat cycle, and wherein when a number of attempts to close the electrical contacts of the at least one pressure switch by increasing the speed of the induced draft blower is equal to or greater than a threshold number of attempts, the furnace controller is configured to de-energize the gas valve and shut off the combustion heat cycle by controlling the backup electrical relay and the electrical relay.

17. The method of claim 16, wherein the at least one pressure switch comprises:

a low-heat pressure switch that is associated with an operation of the gas furnace at a first firing rate;

a medium-heat pressure switch that is associated with an operation of the gas furnace at a second firing rate; and a high-heat pressure switch that is associated with an operation of the gas furnace at a third firing rate, and wherein the first firing rate is a low firing rate, the second firing rate is a medium firing rate, and the third firing rate is a high firing rate.

* * * * *